US008464492B2

(12) United States Patent
Beausoleil

(10) Patent No.: US 8,464,492 B2
(45) Date of Patent: Jun. 18, 2013

(54) ENGINEERED BLOCKS FOR LANDSCAPE WALL LIGHT FIXTURES

(76) Inventor: David M. Beausoleil, Ridgewood, NJ (US)

( * ) Notice: Subject to any disclaimer, the term of this patent is extended or adjusted under 35 U.S.C. 154(b) by 149 days.

(21) Appl. No.: 13/218,496

(22) Filed: Aug. 26, 2011

(65) Prior Publication Data

US 2013/0019546 A1 Jan. 24, 2013

Related U.S. Application Data

(63) Continuation-in-part of application No. 13/187,719, filed on Jul. 21, 2011.

(51) Int. Cl.
*E04C 2/04* (2006.01)

(52) U.S. Cl.
USPC ..... 52/606; 52/28; 52/220.1; 52/596

(58) Field of Classification Search
USPC ..... 52/28, 173.1, 220.1, 220.2, 220.3, 52/503–505, 596, 605–607
See application file for complete search history.

(56) References Cited

U.S. PATENT DOCUMENTS

| | | | | |
|---|---|---|---|---|
| 891,313 | A | | 6/1908 | White |
| 3,055,510 | A | | 2/1960 | Coates |
| D281,725 | S | | 12/1985 | Schreiner |
| D283,550 | S | | 4/1986 | Greco |
| 4,797,112 | A | | 1/1989 | Weisenburger |
| D303,849 | S | | 10/1989 | Nugent |
| D318,536 | S | | 7/1991 | Jones et al. |
| 5,044,971 | A | | 9/1991 | Hollingsworth |
| D322,813 | S | | 12/1991 | Wilson |
| 5,072,566 | A | * | 12/1991 | Zeidman ..... 52/608 |
| D333,086 | S | | 2/1993 | Karas et al. |
| D337,011 | S | | 7/1993 | Duffy et al. |
| 5,258,572 | A | | 11/1993 | Ozeki et al. |
| D351,195 | S | | 10/1994 | Altman |
| D361,138 | S | | 8/1995 | Moore et al. |
| D382,245 | S | | 8/1997 | Bedrosian et al. |
| D397,489 | S | | 8/1998 | Alexander |
| 5,943,827 | A | | 8/1999 | Okerlund |
| D422,107 | S | | 3/2000 | Meier |
| D429,457 | S | | 8/2000 | Thomas |
| 6,122,881 | A | * | 9/2000 | Aubertot ..... 52/604 |

(Continued)

OTHER PUBLICATIONS

Integral Lighting brochure entitled, "Hardscape Lighting Solutions," Integral Lighting, 165 West Fairview Street, Wernersville, PA 19565, www.integral-lighting.com, 16 pp., 2010.

*Primary Examiner* — William Gilbert
*Assistant Examiner* — Patrick Maestri
(74) *Attorney, Agent, or Firm* — Doherty & Charney LLC

(57) ABSTRACT

An engineered block for a landscape wall includes front and rear faces, first and second sidewalls, a top surface extending between upper ends of the front and rear faces, and a bottom surface extending between lower ends of the front and rear faces. A stepped cavity is formed in the top surface of the engineered block. The stepped cavity is located adjacent the front face of the engineered block and includes a first step having a first horizontal, and a shallower second step, adjacent the first step, having a second horizontal surface. A mounting device adapted to receive a light fixture is seated within the stepped cavity. The mounting device has a flat plate seated upon the second step and a storage compartment for wire seated upon the first step. A top planar surface of the flat plate is coplanar with the top surface of the engineered block.

18 Claims, 17 Drawing Sheets

U.S. PATENT DOCUMENTS

| | | | | |
|---|---|---|---|---|
| D454,962 | S | 3/2002 | Grace | |
| 6,360,508 | B1 | 3/2002 | Pelfrey et al. | |
| D482,261 | S | 11/2003 | Kobayashi | |
| 6,708,504 | B2 | 3/2004 | Brandt et al. | |
| 6,976,765 | B2 | 12/2005 | Helenowski | |
| D534,790 | S | 1/2007 | Garda | |
| D550,541 | S | 9/2007 | Blanchard | |
| 7,290,904 | B2 | 11/2007 | Miller | |
| D564,128 | S | 3/2008 | Hartman | |
| D570,037 | S | 5/2008 | Hartman | |
| D576,763 | S | 9/2008 | Hartman | |
| D583,649 | S | 12/2008 | Parker | |
| D586,453 | S | 2/2009 | Yusa et al. | |
| 7,524,077 | B2 | 4/2009 | Hartman | |
| D621,989 | S | 8/2010 | Proner | |
| D639,142 | S | 6/2011 | Antonic | |
| 2009/0071682 | A1 | 3/2009 | Crawford, Jr. | |
| 2009/0288354 | A1* | 11/2009 | Donohew | 52/220.1 |

* cited by examiner

ENGINEERED BLOCKS FOR LANDSCAPE WALL LIGHT FIXTURES

CROSS-REFERENCE TO RELATED APPLICATIONS

The present application is a continuation-in-part of commonly owned U.S. patent application Ser. No. 13/187,719, filed Jul. 21, 2011, entitled "Mounting Devices for Securing Light Fixtures to Landscape Walls," the disclosure of which is hereby incorporated by reference herein.

BACKGROUND OF THE INVENTION

1. Field of the Invention

The present invention is generally related to light fixtures and is more specifically related to mounting systems and devices used for securing light fixtures to walls, such as pre-engineered landscape walls and retaining walls.

2. Description of the Related Art

Light fixtures are often attached to landscape walls to provide pathway lighting, task lighting, and aesthetically pleasing light patterns. Difficulties arise, however, when it later becomes necessary to remove a light fixture from a landscape wall to perform maintenance or repairs. In some instances, the landscape wall must be at least partially disassembled to remove the light fixture and/or access electrical wiring used to power the light fixture. Frequently, the electrical wiring needs to be replaced, but is embedded in a cured mortar layer or adhesive. Thus, repairing and maintaining light fixtures on landscape walls can be an expensive and time consuming process that requires the services of both a mason and an electrician.

There have been many efforts directed to providing mounting devices and systems for securing light fixtures to landscape walls. For Example, U.S. Pat. No. 7,290,904 to Miller discloses a lighting system having an elongated light fixture support flange that is positioned between the blocks of a wall. The elongated flange includes a stop member that provides an indication of when the elongated flange has been sufficiently advanced between two blocks of the wall. The elongated flange has a coupling member, and the light fixture has a bracket used for securing the light fixture to the coupling member. The bracket provides for easy removal and positioning of the light fixture relative to the elongated flange. When it is desired to perform maintenance on the light fixture, the light fixture is removed from the coupling member by sliding the bracket off of the coupling member.

U.S. Pat. No. 7,524,077 to Hartman discloses a lamp used for illuminating a wall constructed of blocks. The lamp includes a plate having a flange attached thereto, with a light fixture attached to the inner face of the flange. The lamp is integrated into a retaining wall by sliding the plate between the blocks, whereby the electrical wiring extending from the rear of the lamp runs between the block-like elements. U.S. Design Pats. D564,128 and D570,037 are related to the '077 Hartman patent, and disclose ornamental designs for a light fixture and an asymmetric light fixture, respectively.

Integral Lighting of Wernersville, Pa. sells a flat mounting plate that is positioned beneath a cap stone of a wet mortar wall. A light fixture is positioned atop the flat mounting plate. The electrical wiring for the light fixture extends between the underside of a capstone and the upper surface of the flat mounting plate. The electrical wiring is exposed to the environment and is locked in place by the mortar layer.

U.S. Pat. No. 6,976,765 to Helenowski discloses a light source that is disposed within a block-shaped enclosure that forms a part of a wall. The enclosure is the same size and shape as one of the blocks of the wall, and may be utilized in place of one of the blocks when the wall is built. The enclosure may also be substituted for one of the blocks after the wall is built. In one embodiment, a support bar is disposed within the wall and welded to the enclosure for preventing the enclosure from being removed from the wall.

U.S. Pat. No. 5,943,827 to Okerlund discloses a retaining wall block having recesses and channels formed therein for receiving light fixtures and electrical wiring. In one embodiment, an underside of a block has a recess for a light fixture and a channel for electrical wiring. The light fixture is inserted into the recess and the electrical wiring for the light fixture is inserted into the channel.

In spite of the above advances, there remains a need for improved mounting systems and devices for securing light fixtures to walls made of blocks, bricks, natural stone or pre-engineered wall systems. There also remains a need for light fixture mounting systems and devices that facilitate the installation, repair and maintenance of the light fixtures and the electrical wiring used to power the light fixtures. In addition, there remains a need for a mounting devices and systems having storage compartments that are adapted for receiving, storing, and protecting from the environment, the electrical wiring used to power the light fixtures.

SUMMARY OF THE INVENTION

In one embodiment, an engineered block for a landscape wall preferably includes a front face, a rear face, first and second sidewalls extending between the front and rear faces, a top surface extending between upper ends of the front and rear faces, and a bottom surface extending between lower ends of the front and rear faces. The engineered block desirably includes a stepped cavity formed (e.g. molded or cut) in the top surface of the engineered block, the stepped cavity being located adjacent the front face of the engineered block and including a first step having a first horizontal surface spaced a first distance from the top surface of the engineered block, and a second step, adjacent the first step, having a second horizontal surface spaced a second distance from the top surface of the engineered block that is less than the first distance. In one embodiment, the first and second horizontal surfaces of the first and second steps are preferably parallel to the top surface of the engineered block.

In one embodiment, the stepped cavity desirably includes a first interior sidewall that extends between the first horizontal surface and the top surface of the engineered block, and an opposing second interior sidewall that extends between the first horizontal surface and the second horizontal surface. The first and second interior sidewalls are preferably parallel to one another and perpendicular to the top surface of the engineered block. The first interior sidewall preferably has a height that is greater than the second interior sidewall, and the first and second interior sidewalls desirably extend away from the front face of the engineered block.

In one embodiment, the stepped cavity preferably has a third interior sidewall that extends between the second horizontal surface and the top surface of the engineered block. The third interior sidewall is desirably parallel to the second interior sidewall and perpendicular to the top surface of the engineered block. The third interior sidewall preferably has a height that is less than the height of the second interior sidewall.

In one embodiment, the engineered block preferably has a first conduit channel formed in the top surface of the engineered block and extending between the first and second sidewalls, and a second conduit channel formed in the top surface of the engineered block and extending from the rear face toward the front face of the engineered block. The first and second conduit channels desirably intersect one another at a conduit hub located adjacent the stepped cavity. In one embodiment, the conduit hub is preferably located between the first step of the stepped cavity and the rear face of the engineered block.

In one embodiment, the engineered block preferably includes a light fixture mounting device seated in the stepped cavity of the engineered block. The light fixture mounting device desirably has a flat plate having a top planar surface and a bottom planar surface, an elongated slot extending between the top and bottom planar surfaces and along a leading edge of the flat plate, and a storage compartment defining an enclosed area underlying the bottom planar surface of the flat plate. The storage compartment is preferably seated upon the first step of the stepped cavity and the flat plate is preferably seated upon the second step of the stepped cavity with the top planar surface of the flat plate being coplanar with the top surface of the engineered block.

The storage compartment desirably has a front opening that is located below the leading edge of the flat plate and a rear opening adjacent a trailing edge of the flat plate. In one embodiment, the leading edge of the flat plate and the front opening of the storage compartment are desirably adjacent the front face of the engineered block and the rear opening of the storage compartment is preferably aligned with the conduit hub. In one embodiment, the leading edge of the flat plate and the front opening of the storage compartment desirably extend along and are aligned with the front face of the engineered block.

In one embodiment, the engineered block may include a removable cover section covering a front end of the first and second steps, the leading edge of the flat plate, and the front opening of the storage compartment. The removable cover section may be selectively removed, such as being chiseled away, cut with a circular diamond saw, or broken with a stone hammer, for exposing the leading edge of the flat plate and the front opening of the storage compartment.

In one embodiment, a conduit adapter is preferably secured to the rear opening of the storage compartment. Conduit for electrical wiring may extend through at least one of the first and second conduit channels. The conduit may be coupled with the conduit adapter for directing the electrical wiring to the conduit adapter and the storage compartment of the mounting device.

In one embodiment, the engineered block preferably includes a light fixture having a securing flange projecting therefrom that is inserted into the elongated slot of the flat plate for securing the light fixture to the mounting device. Electrical wiring is desirably passed through the conduit and the conduit adapter for being electrically coupled with the light fixture.

In one embodiment, an engineered block for a landscape wall desirably includes a front face, a rear face, first and second sidewalls, a top surface, and a bottom surface, and a stepped cavity formed in the top surface of the engineered block. The stepped cavity is preferably located adjacent the front face of the engineered block and includes a first step having a first horizontal surface, and a second step, adjacent the first step, having a second horizontal surface that is shallower than the first step. A light fixture mounting device is desirably seated in the stepped cavity. The engineered block wall is ready made to accept the lighting fixture mounting device so that there is no need for the installer to chisel, cut or break away a portion of the block to accept the mounting device. The light fixture mounting device may include a flat plate having a top planar surface and a bottom planar surface, an elongated slot extending along a leading edge of the flat plate, and a storage compartment defining an enclosed area underlying the bottom planar surface of the flat plate. The storage compartment is adapted for being seated upon the first step, the flat plate is adapted for being seated upon the second step so that the top planar surface of the flat plate is coplanar with the top surface of the engineered block.

The engineered block manufacturer, supplier, distributor or provider could choose to supply the engineered block sections with the fixture mounting bracket cavity interspersed with the solid block sections with the conduit cavity/channel in direct proportion to the amount that would be used on the average wall requiring lighting or not requiring lighting for that matter. This feature would allow any installer on the fly to sell or decide to include the many benefits lighting provide their customer when in the process of building a retaining, decorative or seat wall. An example of this would be providing one engineered block section with the fixture mounting bracket cavity per ten or whatever quantity of solid block sold per pallet. This way every pallet/quantity sold would allow any installer the material required to install a typical landscape stone wall lighting system. A engineered block wall manufacturer, supplier, distributor or product provider could also choose to include the conduit and mounting bracket along with every wall system sold so that at a future date the customer could install a lighting system easily without disturbing the engineered wall.

In one embodiment, the stepped cavity preferably has a first interior sidewall that extends between the first horizontal surface and the top surface of the engineered block, and an opposing second interior sidewall that extends between the first horizontal surface and the second horizontal surface of the second step. The first and second interior sidewalls are desirably parallel to one another and perpendicular to the top surface of the engineered block. The first interior sidewall preferably has a height that is greater than the second interior sidewall.

In one embodiment, the stepped cavity desirably includes a third interior sidewall that extends between the second horizontal surface of the second step and the top surface of the engineered block. The third interior sidewall is preferably parallel to the second interior sidewall, and the third interior sidewall desirably has a height that is less than the height of the second interior sidewall.

The stepped cavity may also include a rear interior wall that extends vertically between a rear end of the second horizontal surface and the top surface of the engineered block. In one embodiment, the rear wall is parallel to the front face of the engineered block and perpendicular to the top surface of the engineered block.

In one embodiment, a light fixture mounting device is seated in the stepped cavity of the engineered block. The light fixture mounting device preferably includes a flat plate having a top planar surface and a bottom planar surface, an elongated slot extending between the top and bottom planar surfaces and along a leading edge of the flat plate, and a storage compartment defining an enclosed area underlying the bottom planar surface of the flat plate. The storage compartment is preferably seated upon the first step of the stepped cavity, the flat plate is preferably seated upon the second step of the stepped cavity, and the top planar surface of the flat plate is desirably coplanar with the top surface of the engineered block.

In one embodiment, the flat plate preferably has a length that is equal to the distance between the first interior wall and the third interior wall of the stepped cavity, and a width that is preferably equal to the distance between the rear interior wall of the stepped cavity and the front face of the engineered block.

In one embodiment, an engineered block for a landscape wall preferably has a front face, a rear face, and a top surface extending between the front and rear faces. A stepped cavity is preferably formed in the top surface of the engineered block, the stepped cavity being located adjacent the front face of the engineered block and having a first step with a first horizontal surface that is parallel to the top surface of the engineered block, and a second step with a second horizontal surface that is parallel to the top surface of the engineered block. The second horizontal surface is desirably closer to the top surface of the engineered block than the first horizontal surface. The engineered block preferably includes a light fixture mounting device having a flat plate with a top planar surface and a bottom planar surface, an elongated slot extending between the top and bottom planar surfaces and along a leading edge of the flat plate, and a storage compartment defining an enclosed area underlying the bottom planar surface of the flat plate. The mounting device is preferably disposed within the stepped cavity with the storage compartment seated upon the first step, the flat plate seated upon the second step, and the top planar surface of the flat plate being coplanar with the top surface of the engineered block.

In one embodiment, a system for securing light fixtures to a wall includes at least one mounting device adapted to be affixed to a wall, such as a wet mortar wall or an engineered block wall, during initial construction. In one embodiment, the mounting device preferably has an L-shaped configuration and includes a flat, horizontally-extending plate having an elongated slot adapted to receive a securing flange projecting from a rear end of a light fixture, and a storage compartment positioned beneath the elongated slot that is adapted to receive and store electrical wires and the accompanying raceway/conduit that connect the light fixture to a power source.

In one embodiment, a series of mounting devices may be placed along the length of a wall for mounting a plurality of light fixtures to the wall. During initial wall construction, a mason may pre-position multiple mounting devices within a wet mortar layer at various locations along the length of the wall. The mounting device enables an installer to run flexible conduit to the back of each device so that electrical wires may be passed through the conduit for initial installation, or removed and replaced in the event of failure. The mounting device, and particularly the storage compartment of the mounting device, protects the electrical wires from exposure to the environment.

After the wall has been built, a lighting contractor may connect the electrical wiring with each of the light fixtures. In one embodiment, a light fixture is mounted to a wall by slipping the securing flange on the light fixture into the elongated slot of the mounting device. The friction between the securing flange and inner faces of the elongated slot holds the light fixture in place. The storage compartment of the mounting device provides a protected area for placing the electrical wiring that extends from the rear of the light fixture. Any slack electrical wiring may be folded and stored in the storage compartment. The mounting device enables an installer to easily remove, repair, replace, maintain, clean, and then reinstall the light fixture in a wall.

In one embodiment, a mounting system for securing a light fixture to a wall, such as a landscape wall, engineered block wall, wet laid mortar wall, natural stone wall or retaining wall, preferably includes a mounting device having a flat plate with a top planar surface, a bottom planar surface, and an elongated slot extending between the top and bottom planar surfaces and along an edge of the flat plate. The elongated slot formed in the flat plate preferably has a length of about 4-8 inches and more preferably about 6 inches, and a width of about 0.030-0.050 inches and more preferably about 0.040 inches. The mounting device also desirably includes a storage compartment defining an enclosed area underlying the bottom planar surface of the flat plate. The enclosed area of the storage compartment is adapted for receiving electrical wiring used for interconnecting a light fixture with a power source.

The mounting system desirably includes a light fixture having a securing flange projecting therefrom that is insertable into the elongated slot of the mounting device for securing the light fixture to the mounting device. The securing flange projecting from the light fixture preferably has a thickness that closely matches the width of the elongated slot for forming a friction fit when the securing flange is inserted into the elongated slot. When sliding the securing flange into the elongated slot for securing the light fixture to the mounting device, the securing flange frictionally engages the opposing faces of the elongated slot for securing the light fixture to the mounting device. The frictional engagement holds the light fixture in place, while enabling the light fixture to be quickly removed from the elongated slot, if necessary, for replacing, maintaining and/or repairing the light fixture. After replacement, maintenance and/or repairs are completed, the light fixture may be quickly and easily re-secured to the mounting device by sliding the securing flange back into the elongated slot.

In one embodiment, the flat plate of the mounting device preferably has a leading edge and a trailing edge, whereby the top and bottom planar surfaces extend between the leading and trailing edges. The elongated slot desirably extends along the leading edge of the flat plate, and the storage compartment preferably extends between the leading and trailing edges of the flat plate.

In one embodiment, the flat plate has first and second lateral edges extending between the leading and trailing edges, and the storage compartment is located adjacent one of the first and second lateral edges of the flat plate. The storage compartment preferably has a front opening extending along the leading edge of the flat plate and a rear opening extending along the trailing edge of the flat plate. The front and rear openings provide access to the enclosed area of the storage compartment so that conduits and electrical wiring may be directed to the enclosed area.

In one embodiment, the storage compartment includes a bottom wall that opposes the bottom planar surface and a pair of opposing sidewalls that extend from the bottom wall to the bottom planar surface for defining the enclosed area of the storage compartment. The bottom wall of the storage compartment is preferably parallel with the top and bottom planar surfaces of the flat plate and the pair of opposing sidewalls of the storage compartment are desirably perpendicular to the top and bottom planar surfaces of the flat plate. As such, the storage compartment preferably has a square or rectangular configuration.

In one embodiment, the mounting system desirably includes a conduit adapter coupled with the storage compartment. The conduit adapter preferably has at least one opening aligned with the rear opening of the storage compartment. In one embodiment, the conduit adapter includes a support plate having an inner face and an outer face, and a plug projecting from the inner face of the support plate. In one embodiment, the plug preferably has an outer perimeter that closely matches an inner perimeter of the rear opening of the storage compartment for forming a frictional engagement between the plug and the rear opening. In one embodiment, the conduit adapter is bonded to the rear opening of the storage compartment using an adhesive, glue or solvent such as PVC cement that bonds the conduit adapter to the storage compartment.

In one embodiment, the at least one opening formed in the conduit adapter preferably passes through the support plate and the plug. The system desirably includes a conduit, such as a flexible conduit, coupled with the at least one opening in the conduit adapter. The conduit desirably has a central opening adapted to receive electrical wiring that is connected with the light fixture. In one embodiment, the at least one opening in the conduit adapter preferably includes two or more openings extending through the support plate and the plug. Each of the openings is capable of receiving a conduit, and each conduit, in turn, is capable of receiving electrical wiring that extends into said storage compartment. The conduit adapter may have tubes that define the openings, whereby the conduits are insertable into the tubes for directing electrical wiring toward the mounting devices.

In one embodiment, a mounting system for securing a light fixture to a landscape wall preferably includes a mounting device having a flat plate with a leading edge, a trailing edge, and top and bottom planar surfaces extending between the leading and trailing edges, and an elongated slot formed in the flat plate, the elongated slot extending between the top and bottom planar surfaces and along the leading edge of the flat plate. The mounting device desirably includes a storage compartment underlying the flat plate, the storage compartment defining an enclosed area extending between the leading and trailing edges of the flat plate. The storage compartment preferably has a front opening extending along the leading edge of the flat plate and a rear opening extending along the trailing edge of the flat plate.

In one embodiment, a conduit adapter is preferably inserted into the rear opening of the storage compartment. The conduit adapted desirably has at least opening aligned with the rear opening of the storage compartment for providing access to the enclosed area of the storage compartment. A conduit is desirably coupled with the at least one opening. The conduit preferably has a central opening through which electrical wiring may be advanced for being interconnected with a light fixture secured to the mounting device.

In one embodiment, the mounting devices and the conduit (s) may be pre-positioned during initial construction of a wall. Later, after the wall construction has been completed, electrical wiring may be passed through the conduit(s) for providing power to the light fixtures at each mounting device. After the electrical interconnections have been made, any excess wiring may be packed into the storage compartments and the securing flanges of the light fixtures may be inserted into the elongated slots on the mounting devices. In one embodiment, the excess wiring in the storage compartment may be held in place by using the flat back side of the lighting fixture, which effectively closes the front opening of the storage compartment when the light fixture is fully inserted in the mounting device.

In one embodiment, a wall, such as a landscape wall or a retaining wall, desirably includes a top row of blocks and at least one mounting device overlies the top row of blocks. In one embodiment, a plurality of mounting devices overlies the top row of blocks and is spaced along the length of the wall.

The system may include a mortar layer having a top surface overlying the top row of blocks, whereby each mounting device is embedded in the mortar layer so that the top planar surface of the flat plate is coplanar with the top surface of the mortar layer and so that the storage compartment of the mounting device is positioned below the top surface of the mortar layer. In one embodiment, a wet mortar layer is formed atop the wall, and one or more mounting devices are embedded in the wet mortar layer so that the top planar surfaces of the flat plates of the mounting device lie in a plane defined by the top surface of the wet mortar layer. The wet mortar layer may then be allowed to cure for locking the mounting devices in place within the wet mortar layer, whereby the elongated slots and the front storage compartment openings of the mounting devices are accessible at the front face of the wall. In one embodiment, the mounting devices disclosed herein may be placed at any level or row of a wall, and are not limited to placement under a cap stone or a top or uppermost layer of a wall.

In one embodiment, an adhesive label may be used for sealing the storage compartment and the elongated slot in the flat plate from construction debris. The label may bear the manufacturer's name or logo, and/or instructions for utilizing the light fixture mounting system. The adhesive label may be placed over the bottom wall for sealing the elongated gap in the bottom wall of the storage compartment so as to prevent concrete and other construction debris from entering the enclosed area of the storage compartment. The front flap of the adhesive label may be wrapped around the front of the mounting device for covering the front opening of the storage compartment. The free end of the front flap may be adhered to the top planar surface of the flat plate for protecting the storage compartment and at least a portion of the elongated slot formed in the flat plate. The front flap of the adhesive label may be opened and closed as necessary by peeling the front flap away from the flat plate and later re-adhering the front flap of the adhesive label to the top planar surface of the flat plate.

In one embodiment, the adhesive label may be used for holding electrical wires in place prior to the wires being electrically interconnected with a light fixture. Electrical wires may be passed through flexible conduit and the front opening of the storage compartment for being pre-positioned to extend from the front of the mounting device. The adhesive label preferably holds the electrical wires in place and seals the front of the storage compartment to prevent construction debris from entering the storage compartment and at least a portion of the elongated slot formed in the flat plate. When it is desired to secure a light fixture to the mounting device, the front flap of the adhesive label may be peeled away for exposing the front opening of the storage compartment so that the electrical wires may be electrically interconnected with a light fixture.

These and other preferred embodiments of the present invention will be described in more detail below.

DETAILED DESCRIPTION

Figure 1:
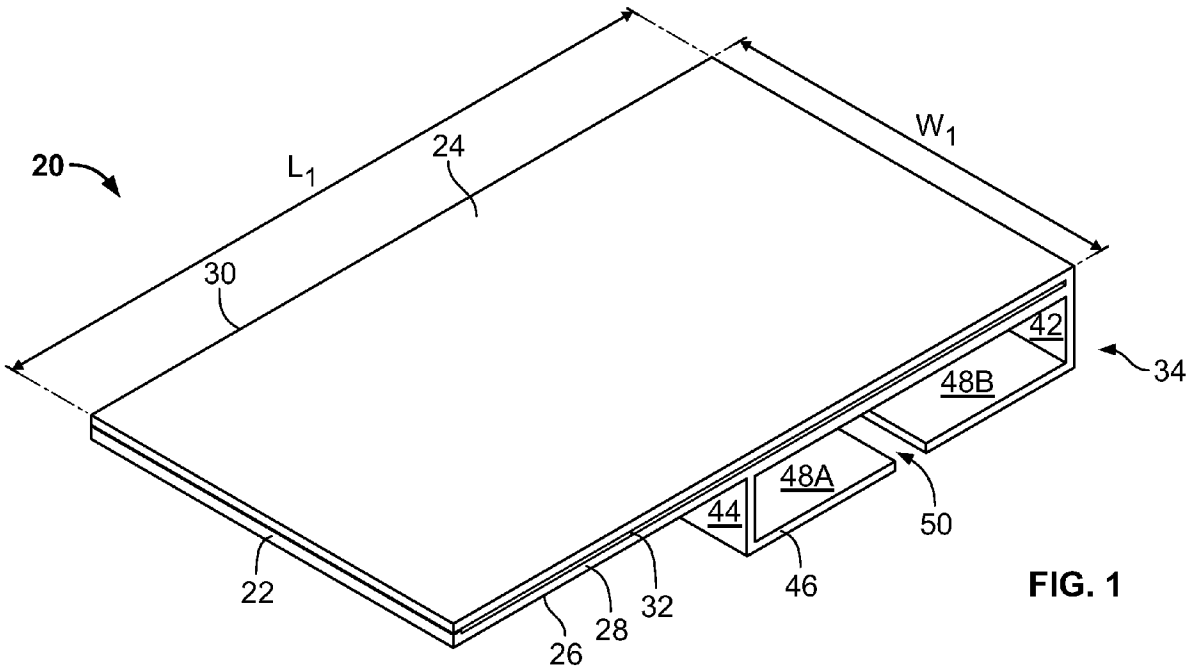
FIG. 1 is a perspective view of a mounting device for securing a light fixture to a landscape wall, in accordance with one embodiment of the present invention.
Figure 2:
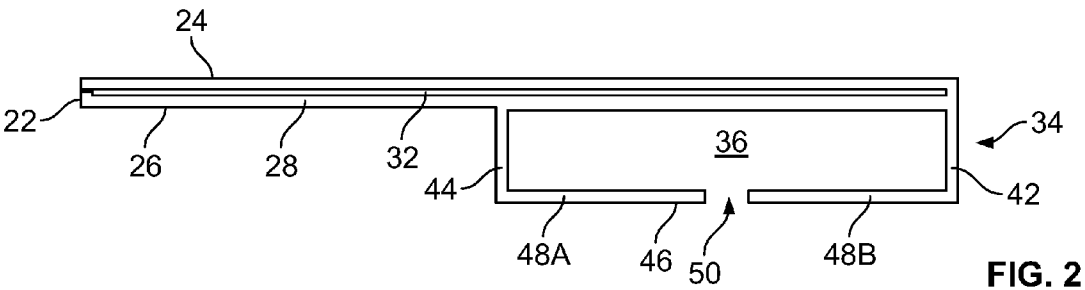
FIG. 2 is a front elevational view of the mounting device shown in FIG. 1.
Figure 3:
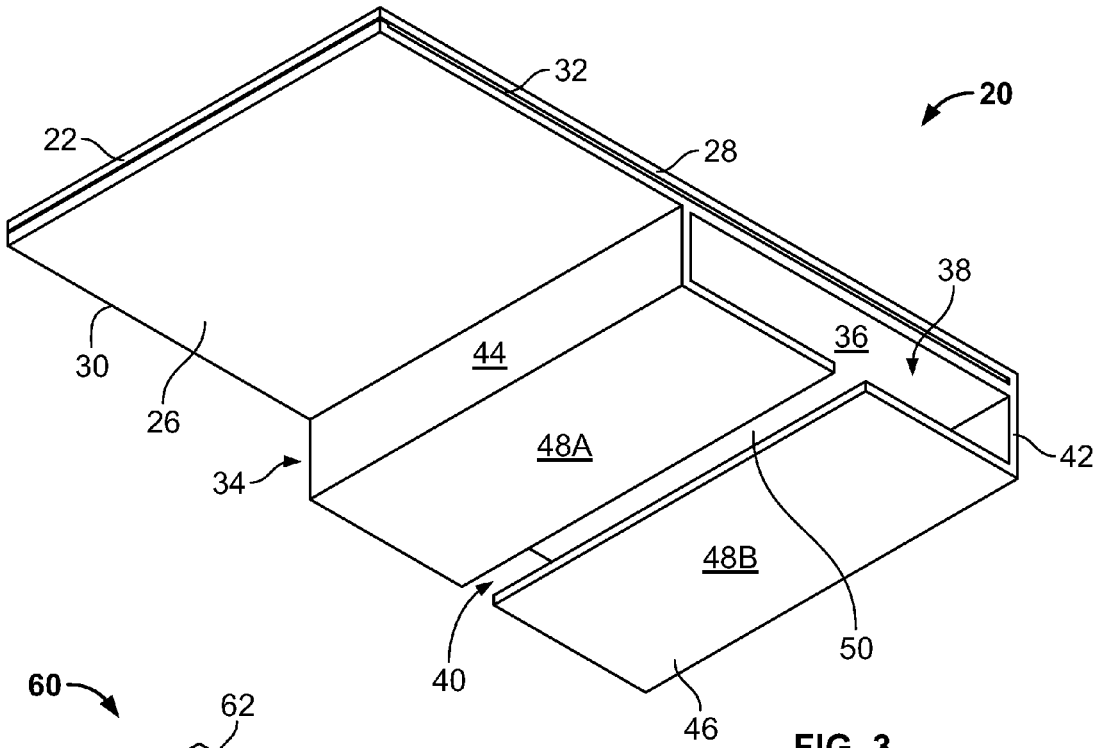
FIG. 3 is a bottom perspective view of the mounting device shown in FIGS. 1 and 2.

Referring to FIGS. 1-3, in one embodiment, a mounting device 20 for securing a light fixture to a wall, such as a landscape wall or a retaining wall, preferably includes a flat plate 22 having a top planar surface 24 and a bottom planar surface 26. The flat plate desirably includes a leading edge 28 that extends along the front face of the mounting device 20 and a trailing edge 30 that extends along a rear face of the mounting device. In one embodiment, the flat plate 22 has a length $L_1$ of about 5-7 inches and more preferably about 8 inches, and a width $W_1$ of about 3-4 inches, and more preferably about 3.5 inches. The walls of the mounting device are preferably about 0.05-0.10 inches thick and more preferably about 0.08 inches thick In one embodiment, the mounting device 20 desirably includes an elongated slot 32 that is formed in the flat plate and that extends between the top planar surface 24 and the bottom planar surface 26. The elongated slot 32 desirably extends along the leading edge 28 of the mounting device. As will be described in more detail herein, the elongated slot 32 is adapted to receive a securing flange projecting from a rear surface of a light fixture.

The mounting device 20 preferably includes a storage compartment 34 that is positioned below the flat plate 22. The storage compartment 34 preferably defines an enclosed area 36 extending between the leading edge 28 and the trailing edge 30 of the flat plate. In one embodiment, the storage compartment may have a rectangular or square shape. The storage compartment 34 desirably includes a front opening 38 accessible at the leading edge 28 of the flat plate 22 and a rear opening 40 accessible at the trailing edge 30 the flat plate 22.

Referring to FIG. 2, in one embodiment, the storage compartment 34 of the mounting device 20 desirably includes an outer sidewall 42 and an inner sidewall 44. The outer and inner sidewalls 42, 44 are preferably parallel to one another and extend between the leading and trailing edges 28, 30 of the flat plate 22. The storage compartment 34 also desirably includes a bottom wall 46 that extend between lower ends of the outer sidewall 42 and the inner sidewall 44. The bottom wall 46 also preferably extends between the leading and trailing edges 28, 30 of the flat plate 22. In one embodiment, the bottom wall 46 is bifurcated into a first part 48A and a second part 48B. The bifurcated wall 46 may include an elongated gap 50 that extends between the first and second parts 48A, 48B thereof.

As will be described in more detail herein, the storage compartment 34 is preferably adapted to receive electrical wiring that is used for connecting a light fixture with a power source. The electrical wiring is preferably stored in the enclosed area 36 defined by the outer sidewall 42, the inner sidewall 44 and the bottom wall 46. The enclosed area 36 protects the electrical wiring from the environment, such as the surrounding blocks and mortar layer in which the mounting device is disposed. The enclosed area 36 also provides a space for packing and/or storing the electrical wiring connected to a light fixture.

In one embodiment, as a securing flange on a rear of a light fixture is inserted into the elongated slot 32, any wiring forming a connection between the light fixture and a power source may be inserted into the enclosed area 36 of the storage compartment 34. Any slack or excess wiring forming the electrical connection with the light fixture may be folded and stored in the storage compartment.

Figure 4:
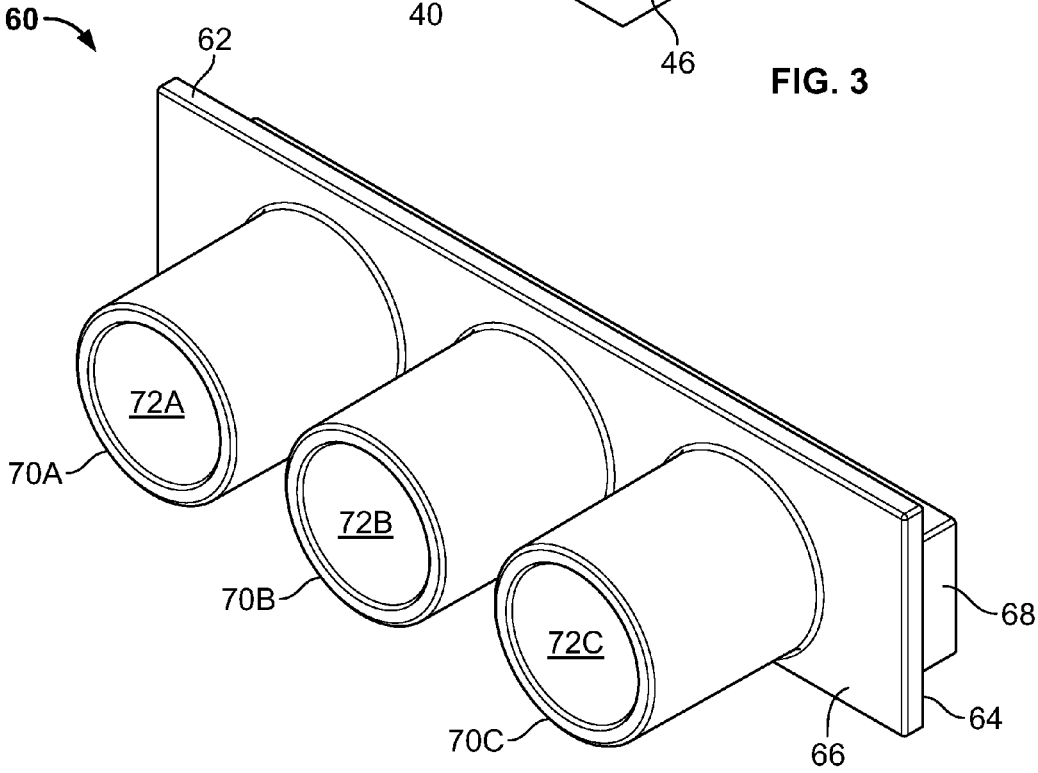
FIG. 4 is a perspective view of a conduit adapter adapted for being connected with the mounting device of FIGS. 1-3, in accordance with one embodiment of the present invention.

Referring to FIG. 4, in one embodiment, a conduit adapter 60 is designed for being connected with the rear opening of the storage compartment 34 shown in FIGS. 1-3. The conduit adapter 60 desirably includes a support plate 62 having a front face 64 and a rear face 66, and a plug 68 projecting from the front face 64 of the support plate 62. In one embodiment, the plug 68 is adapted for being inserted into the rear opening 40 of the storage compartment 34 (FIG. 3). In one embodiment, the conduit adapter is preferably bonded to the storage compartment, such as by using an adhesive, glue, or cement. The conduit adapter 60 desirably includes a set of tubes 70A, 70B, 70C having respective tube openings 72A, 72B, 72C. Each of the tube openings is adapted to receive a conduit for electrical wiring.

Figure 5:
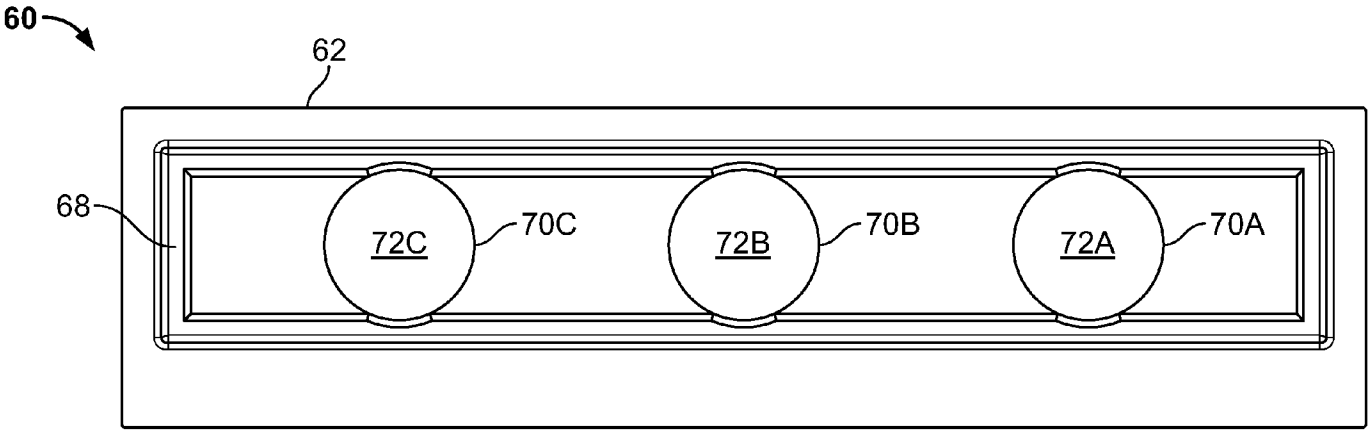
FIG. 5 is a front elevational view of the conduit adapter shown in FIG. 4.
Figure 6:
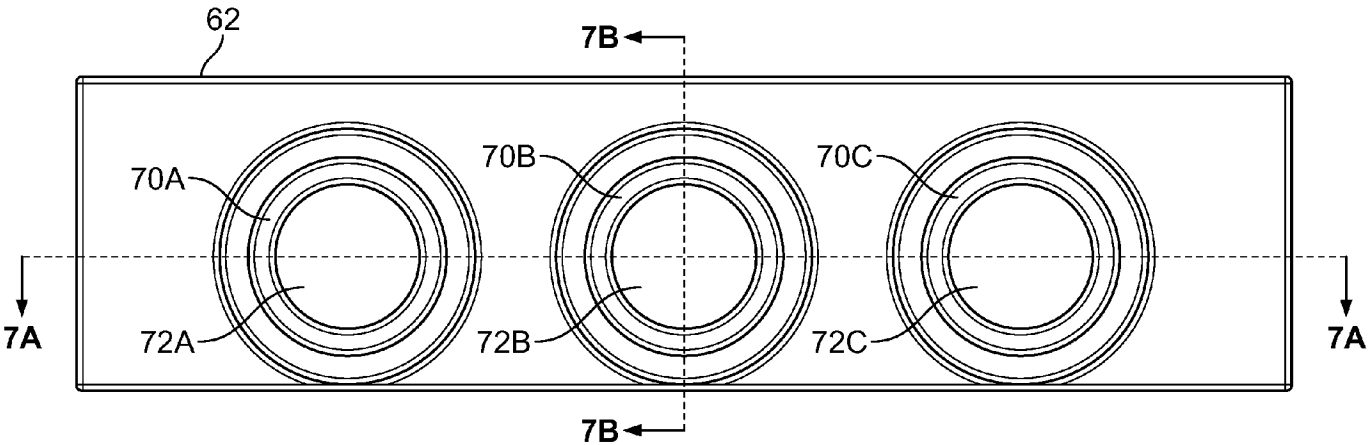
FIG. 6 is a rear elevational view of the conduit adapter shown in FIG. 4.

As shown in FIG. 5, the tube openings 72A-72C extend through the support plate 62 and the plug 68 for providing openings that extend through the conduit adapter 60. Referring to FIG. 6, in one embodiment, the three tubes 70A-70C project from the rear face 66 of the support plate 62.

Figure 7A:
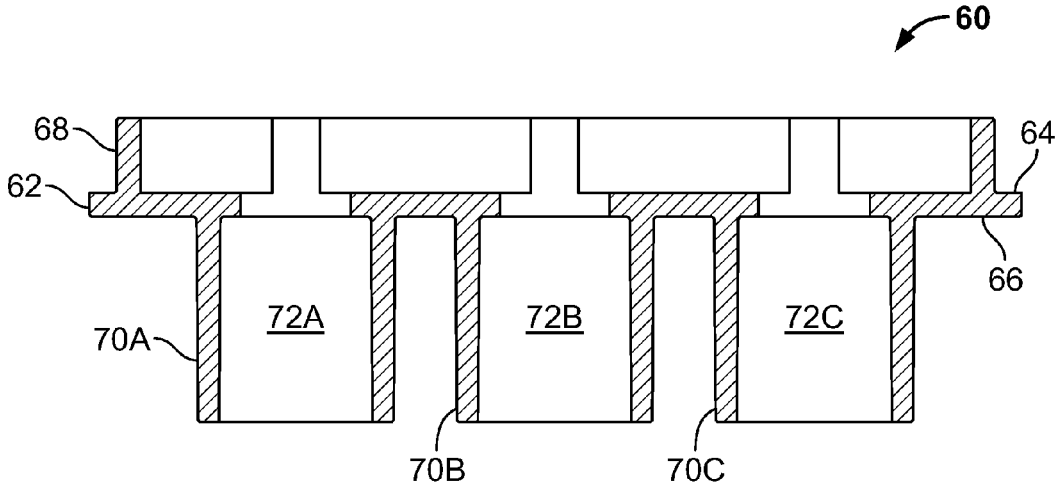
FIG. 7A is a cross-sectional view of the conduit adapter of FIG. 6 taken along line 7A-7A thereof.

Referring to FIG. 7A, the conduit adapter 60 preferably includes the support plate 62 having an inner face 64 and an outer face 66. The three tubes 70A-70C project from the rear face 66 of the support plate 62. The tubes define tube openings 72A-72C that extend through the support plate 62 and through the plug 68. The plug 68 has an outer dimension that preferably forms a frictional fit with the inner dimension of the rear opening 40 of the storage compartment 34 (FIG. 3).

Figure 7B:
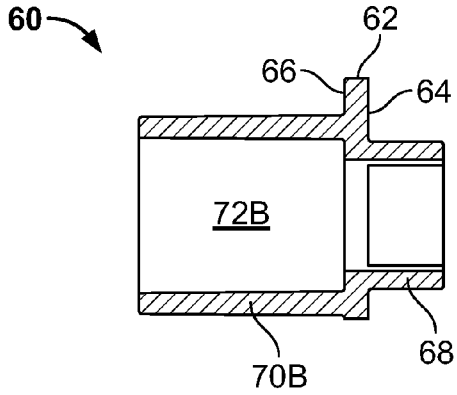
FIG. 7B is a cross-sectional view of the conduit adapter of FIG. 6 taken along line 7B-7B thereof.

FIG. 7B shows a cross-sectional view of the conduit adapter 60 taken along line 7B-7B of FIG. 6. The conduit adapter 60 includes the support plate 62 having an inner face 64 and an outer face 66. The tube 70B defines a tube opening 72B that extends through the support plate 62 and the plug 68. A conduit, such as a flexible conduit, may be coupled with the tube 70B, such as by inserting the conduit into the tube opening 72B, for providing access to an interior region of the storage compartment.

Figure 8A:
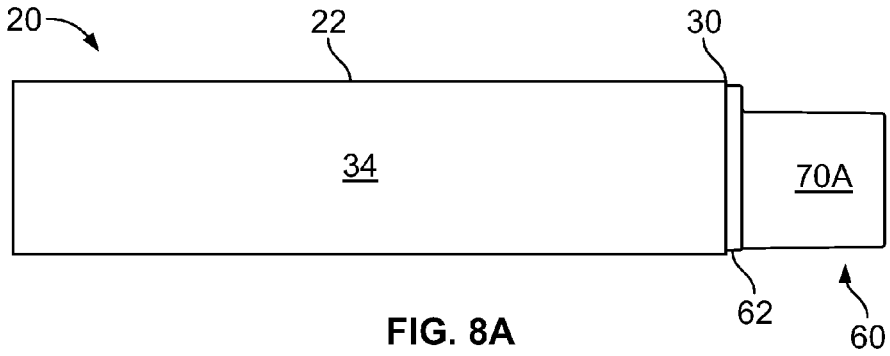
FIG. 8A is a right side elevational view of the conduit adapter of FIG. 4 joined with the mounting device of FIGS. 1-3.

Referring to FIG. 8A, in one embodiment, the conduit adapter 60 is assembled with the mounting device 20 by inserting the plug 68 (FIG. 7B) projecting from the support plate 62 into the rear opening of the storage compartment 34. The tube 70A projects rearwardly from the rear edge 30 of the flat plate 22.

Figure 8B:
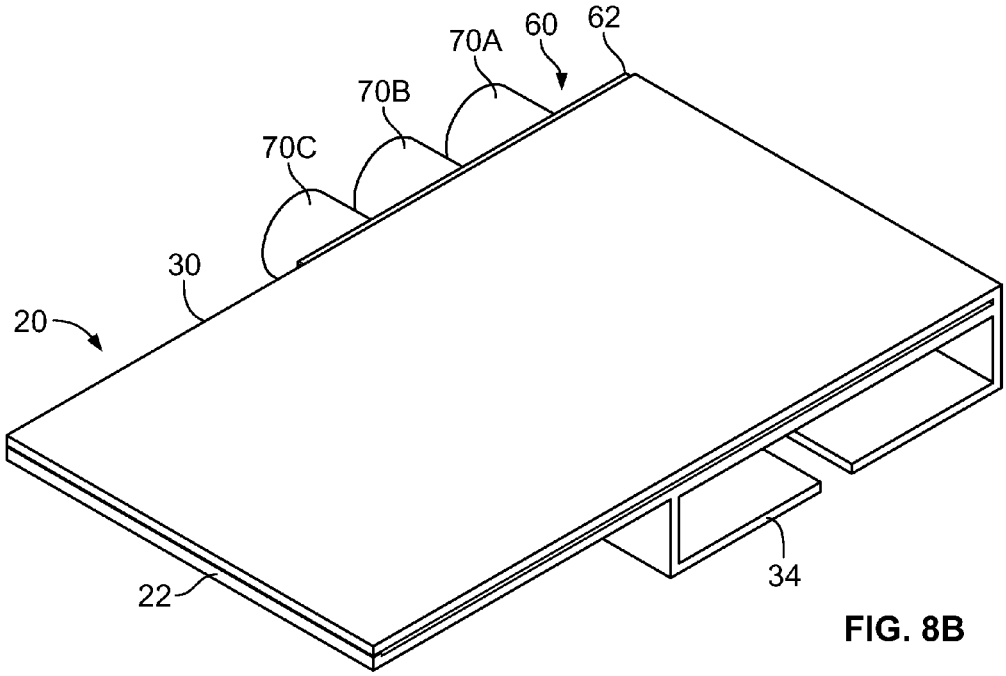
FIG. 8B is a top perspective view of the mounting device and conduit adapter of FIG. 8A.
Figure 8C:
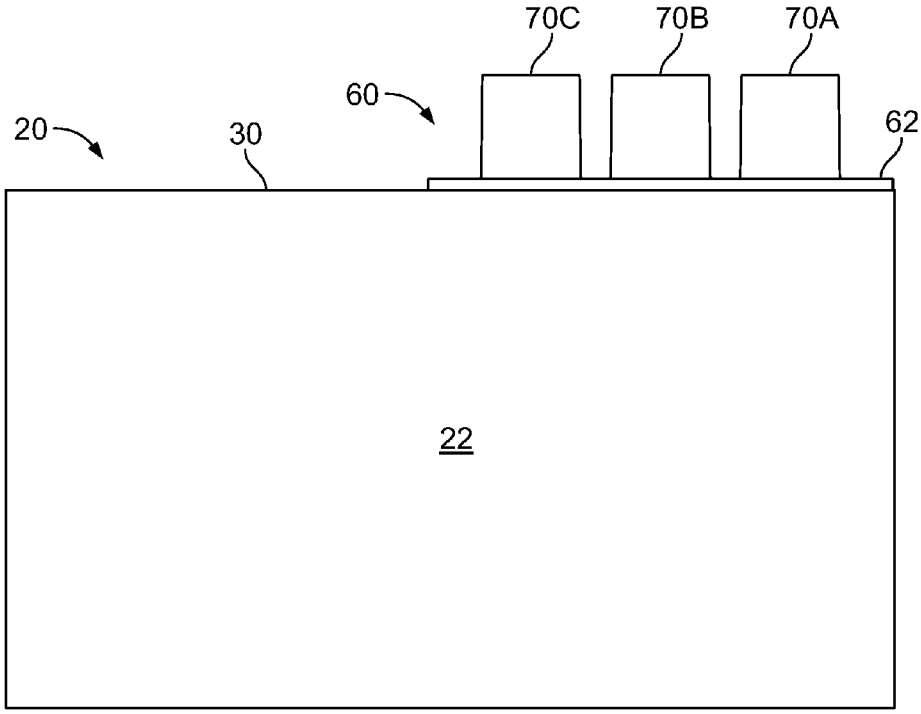
FIG. 8C is a top plan view of the mounting device and conduit adapter of FIGS. 8A and 8B.
Figure 8D:
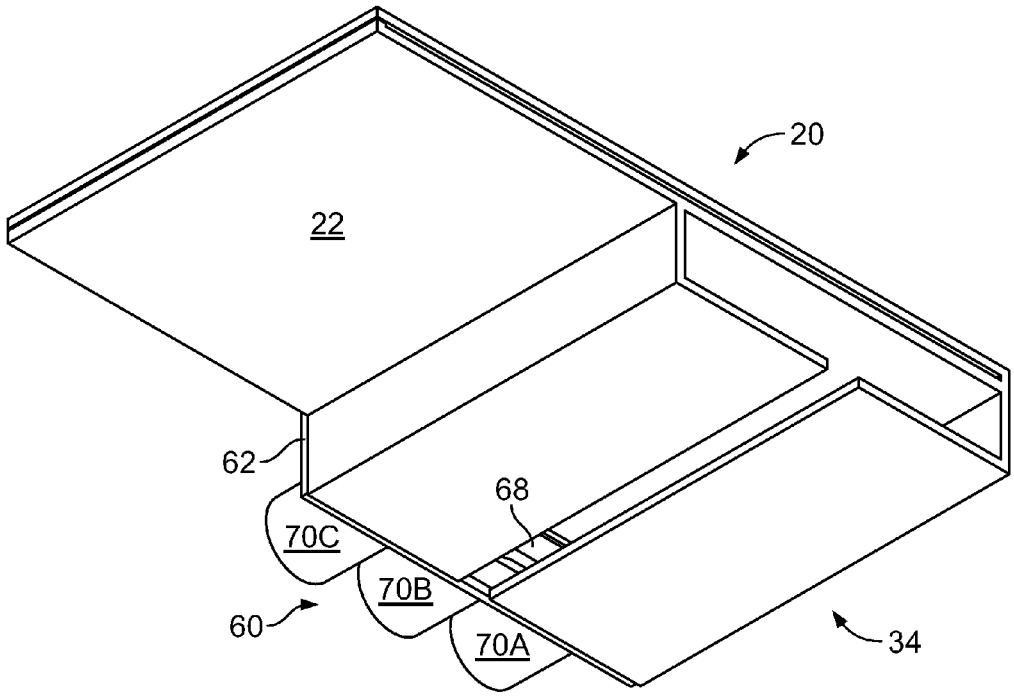
FIG. 8D is a bottom perspective view of the mounting device and conduit adapter of FIGS. 8A-8C.

Referring to FIGS. 8B-8D, after the conduit adapter 60 is secured to the rear opening of the storage compartment 34, the three tubes 70A-70C project rearwardly from the rear edge 30 of the flat plate 22. The three tubes 70A-70C provide openings into the storage compartment. Flexible conduits may be inserted into each of the tubes 70A-70C for providing a protected path for introducing electrical wiring into the storage compartment 34 of the mounting device 20.

Figure 9:
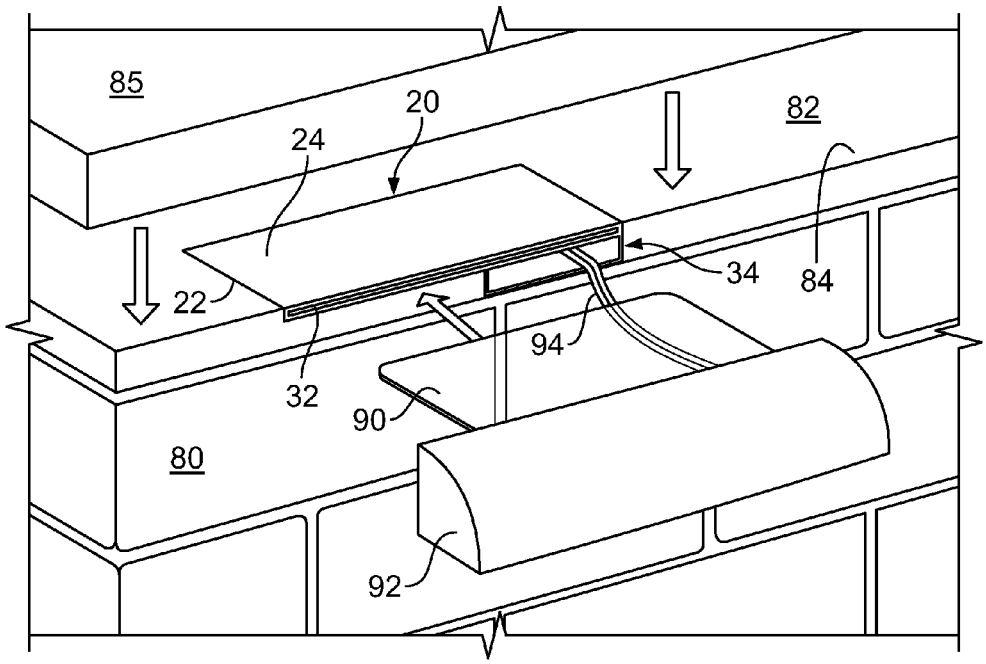
FIG. 9 shows a method of using a mounting device for securing a light fixture to a landscape wall, in accordance with one embodiment of the present invention.

Referring to FIG. 9, in one embodiment, the mounting device 20 described herein may be pre-positioned atop a landscape wall 80 having a wet mortar layer 82. The mounting device 20 may be embedded in the wet mortar layer 82 during construction of the wall so that the top planar surface 24 of the mounting device is aligned with the top surface 84 of the mortar layer 82. After curing, the top planar surface 24 of the flat plate 22 and the top surface 84 of the mortar layer 82 desirably lie in a common plane. A capstone 85 may be positioned over the mortar layer 82 and the mounting device 20 embedded therein.

Although only one mounting device 20 is shown in FIG. 9, the wall 80 may include two or more mounting devices spaced along the length of the mortar layer 82. Each mounting device 20 is preferably embedded within the mortar layer 82 so that the top planar surface 24 lies in a common plane with the top surface 84 of the mortar layer 82 and the storage compartment 34 underlies the flat plate 22. In addition, the mounting device is positioned so that the elongated slot 32 preferably extends along the front face of the wall 80.

In one embodiment, the elongated slot 32 is adapted to receive a securing flange 90 projecting from a rear of a light fixture 92. The securing flange 90 is adapted to slide into the elongated slot 32 for holding the light fixture 92 to the wall 80. The electrical wiring 94 interconnecting the light fixture 92 with a power source may be packed into the storage compartment 34. The storage compartment 34 preferably provides a protected area for minimizing exposure of the electrical wiring 94 to the surrounding environment (e.g. blocks, mortar, moisture, air).

Figure 10:
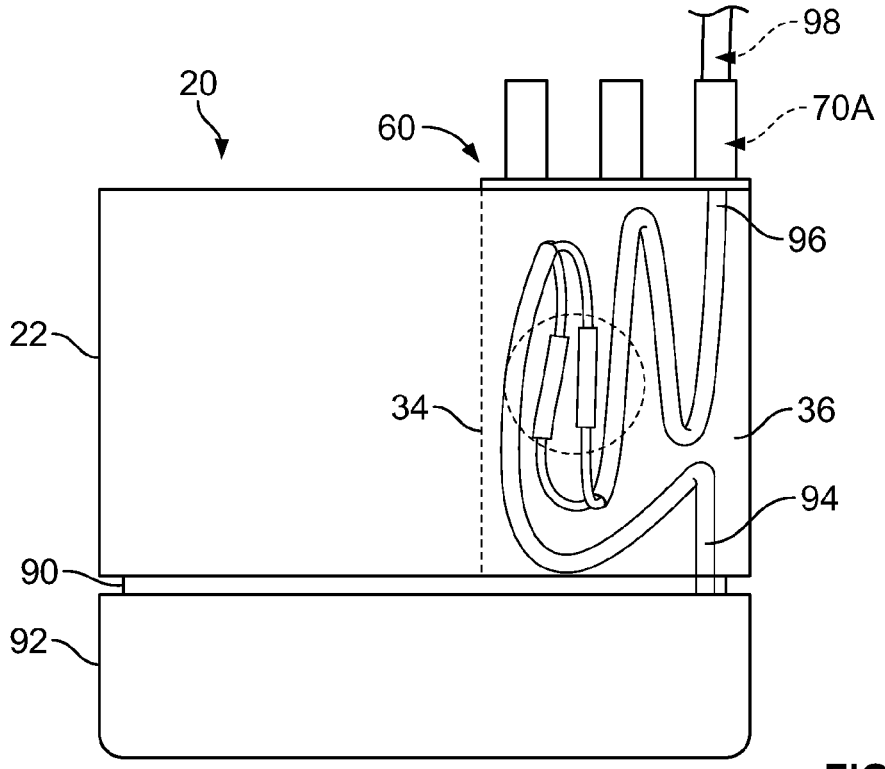
FIG. 10 shows a method of using a mounting device, conduit adapter and conduit for connecting a light fixture to a power source, in accordance with one embodiment of the present invention.

Referring to FIG. 10, in one embodiment, a light fixture 92 having a securing flange 90 is secured to the mounting device 20 by inserting the securing flange 90 into the elongated slot 32 extending along the front edge of the flat plate 22 (FIG. 9). The electrical wiring 94, 96 used for electrically interconnecting the light fixture 92 with a power source is preferably folded and packed into the enclosed area 36 of the storage compartment 34. The first electrical wire 94 is permanently attached to the light fixture 92 and the second electrical wiring 96 is desirably fed through the first tube 70A of the conduit adapter 60.

In one embodiment, a flexible conduit 98 provides a protected passageway for the second electrical wiring 96. The flexible conduit 98 may be pre-positioned during construction of a wall and prior to coupling the light fixture 92 to the second electrical wiring 96. The flexible conduit 98 preferably remains in place after construction of the wall and installation of the light fixture 92. If it is necessary to repair and/or replace the light fixture 92 or the electrical wiring 94, 96, the second electrical wiring 96 may be withdrawn through the flexible conduit 98 and replacement electrical wiring advanced through the conduit 98 for passing through the tube 70A and into the enclosed area 36 of the storage compartment 34.

Although the present invention is not limited by any particular theory of operation, it is believed that utilizing a flexible conduit 98 will enable replacement wiring 94 to be readily passed through the conduit 98 and into the enclosed area 36 of the storage compartment 34, thereby facilitating replacement, repair and/or maintenance of the electrical wiring and the light fixture.

After a period of time, it may be necessary to remove the light fixture 92 from the mounting device 20 for repairing and maintaining the light fixture, or replacing the light fixture with a new light fixture. In those instances, the light fixture 92 may be pulled away from the mounting device 20 so that the securing flange 90 may be retracted from the elongated slot extending along the leading edge of the flat plate 22. As the light fixture 92 is pulled away from the mounting device 20, the electrical wiring 94 is pulled through the first opening of the storage compartment 34, as shown in FIG. 9. After any necessary maintenance and/or repairs have occurred, the electrical wiring 94 may be reconnected with the light fixture 92 and the electrical wiring inserted back inside the storage compartment 34.

Figure 11:
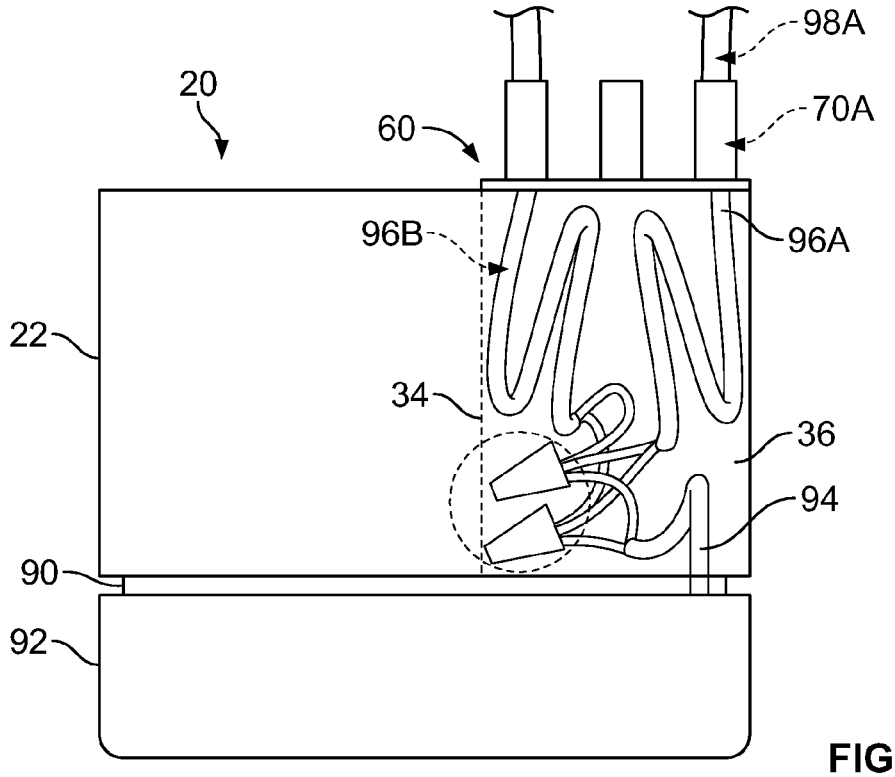
FIG. 11 shows a method of using a mounting device, conduit adapter and conduit for connecting a light fixture with a power source, in accordance with another embodiment of the present invention.

Referring to FIG. 11, in one embodiment, two electrical wires 96A, 96B may be connected with the light fixture 92. The first electrical wire 96A may pass through a first tube 70A and a first conduit 98A for being connected with the electrical wire 94 of the light fixture 92. The second electrical wire 96B may pass through a third tube 70C and a third conduit 98C for being connected with the electrical wire 94 of the light fixture 92. Any slack in the electrical wiring 94, 96A, and 96B may be folded for storage within the storage compartment.

Figure 12:
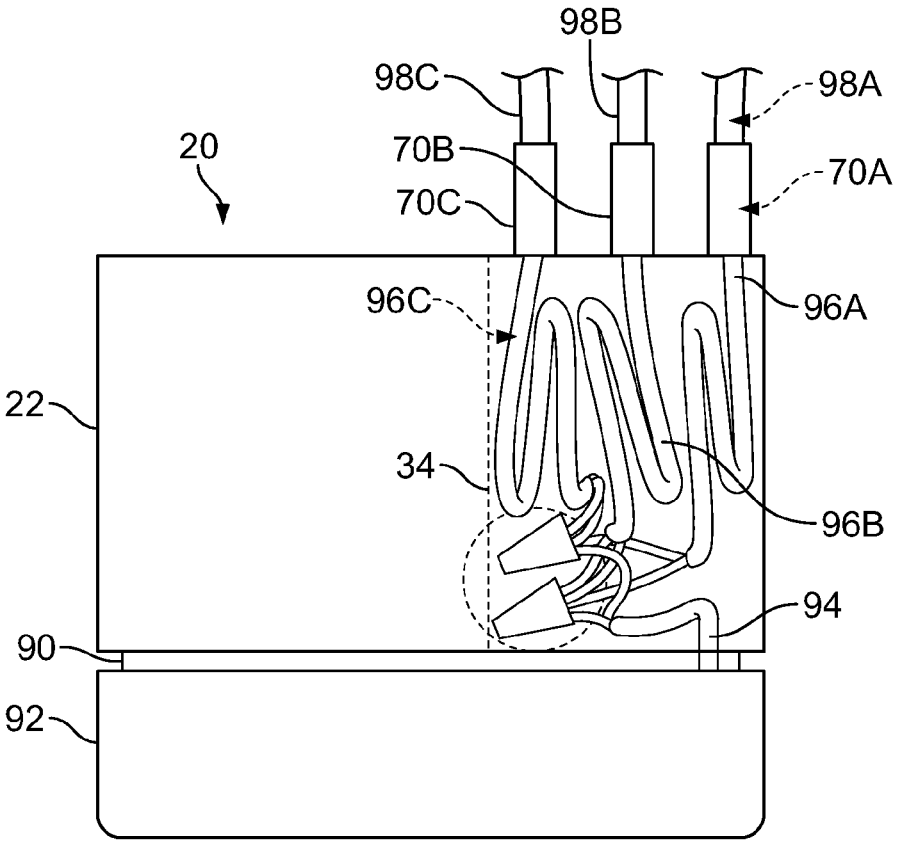
FIG. 12 shows a method of using a mounting device, conduit adapter and conduit for connecting a light fixture with a power source, in accordance with another embodiment of the present invention.

Referring to FIG. 12, in one embodiment, three electrical wires 96A-96C are coupled with the electrical wire 94 of the light fixture 92. The first electrical wire 96A passes through the first flexible conduit 98A and the first tube 70A. The second electrical wire 96B passes through the second tube 70B and the second flexible conduit 98B. The third electrical wire 96C passes through the third tube 70C and the third flexible conduit 98C. The ends of the electrical wires 96A-96C are electrically interconnected with electrical wiring 94 projecting from the rear and of the light fixture 92. After the electrical connection has been made, the electrical wiring is positioned within the storage compartment 34 for being stored within a protected environment. The securing flange 90 on the light fixture 92 is preferably inserted into the elongated slot at the leading edge of the plate 22 of the mounting device 20 for securing the light fixture to the mounting device.

Figure 13:
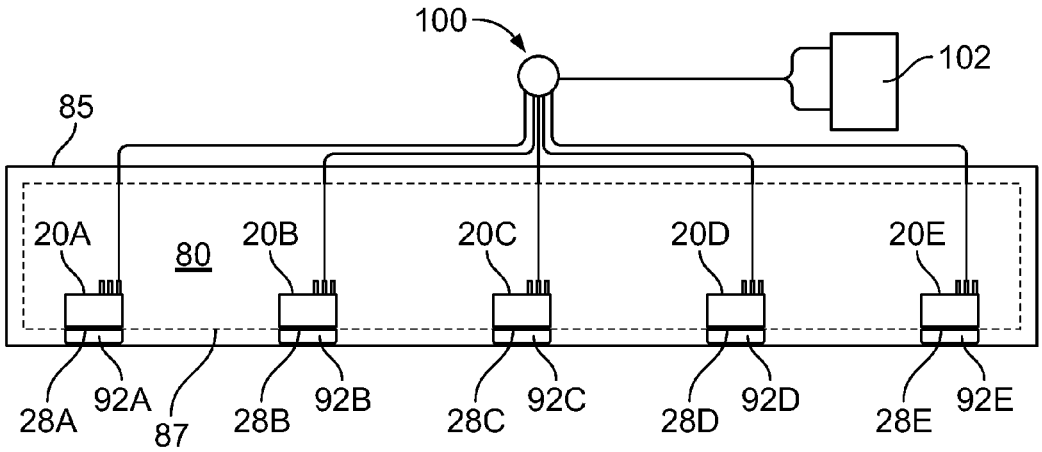
FIG. 13 shows a first wiring pattern for connecting landscape wall light fixtures with a transformer, in accordance with one embodiment of the present embodiment.

Referring to FIG. 13, in one embodiment, a plurality of light fixtures 92A-92E may be positioned along the length of a landscape wall 80. The light fixtures are preferably evenly spaced from one another along the length of the wall. In one embodiment, the mounting devices 20A-20E are spaced along the length of the wall 80 so that the leading edges 28A-28E of the respective mounting devices are aligned with the front face 87 of the wall 80. The mounting device may be embedded in a mortar layer 82 (FIG. 9) of the wall 80. Flexible conduit 98 extends through the mortar layer. Electrical wiring is preferably passed through the conduit 98 for connecting the respective mounting devices 20A-20E with a junction 100, which, in turn, is connected with a transformer 102. A capstone 85 may be placed atop the mortar layer and the mounting devices 20A-20E.

After the electrical wiring has been passed through the flexible conduit 98 for reaching the storage compartments of each of the mounting devices 20A-20E, the electrical wiring passed through the conduit may be electrically interconnected with the wiring permanently attached to the respective light fixtures 92A-92E. Any slack remaining in the electrical wiring may be folded, packed and/or inserted into the storage compartments of the respective mounting devices, as shown and described above in FIGS. 10-12.

Figure 14:
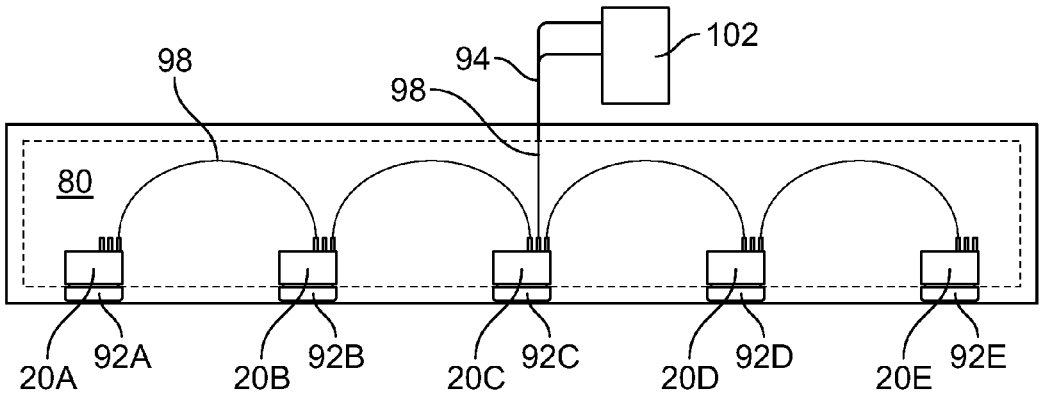
FIG. 14 shows a second wiring pattern for connecting landscape wall light fixtures with a transformer, in accordance with one embodiment of the present invention.

FIG. 14 shows another embodiment whereby light fixtures 92A-92A are spaced along the length of a masonry wall. A transformer 102 is electrically connected with a centrally-located mounting device 20C via electrical wiring 94 that passes through a conduit 98. The mounting devices 20A-20C are interconnected via flexible conduit 98 that extends laterally between the adjacent mounting devices 20A-20C. Electrical wiring may be passed through the conduit(s) 98 for providing electrical power to the light fixtures 92A-92E.

Figure 15:
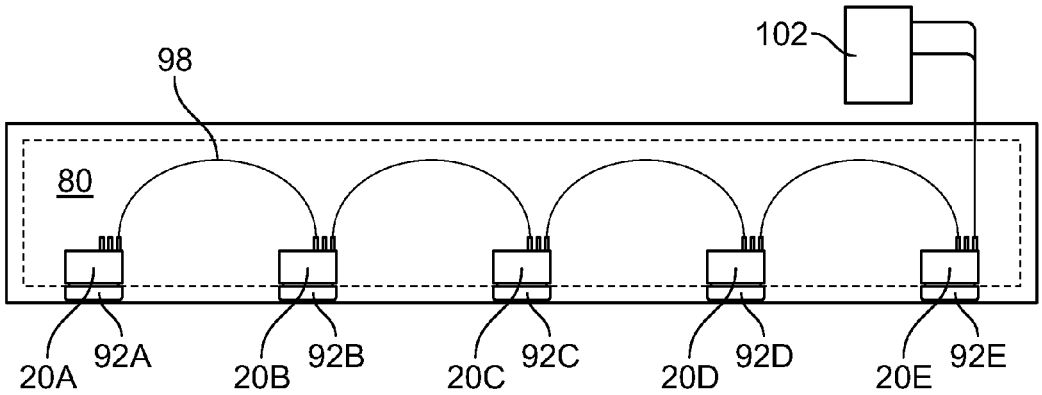
FIG. 15 shows yet another wiring pattern for connecting landscape wall light fixtures with a transformer, in accordance with one embodiment of the present invention.

FIG. 15 shows another wiring methodology having a daisy chain pattern. Flexible conduits 98 extend through a mortar layer and between the spaced mounting devices 20A-20E. Electrical wiring is passed through the flexible conduits 98 for being electrically interconnected with the light fixtures 92A-92E. Operation of the light fixtures 92A-92E is controlled by a transformer 102 that is electrically interconnected with the fifth light fixture 92E.

Figure 16:
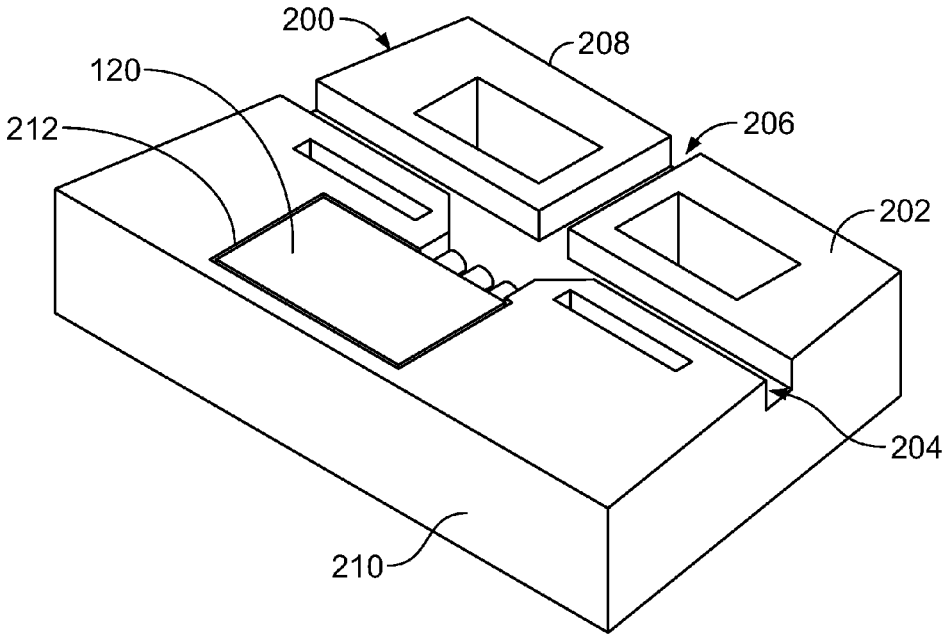
FIG. 16 shows a perspective view of an engineered block used for constructing a landscape wall including a cavity adapted to receive a mounting device for a light fixture, in accordance with one embodiment of the present invention.

The mounting devices and systems disclosed herein may be incorporated into engineered blocks used for constructing landscape walls. Referring to FIG. 16, in one embodiment, a mounting device 120 may be disposed within a stepped cavity of an engineered block 200. The engineered block 200 desirably has a top surface 202 with a first channel 204 extending along the length of the block 200. The first channel 204 is preferably adapted to receive conduit for electrical wiring. When a plurality of engineered blocks 200 are assembled side-by-side to form row of a wall, the first channel 204 preferably extends along the length of the wall. The first channel 204 desirably enables conduit to be extended along the length of a landscape wall for passing electrical wiring through the conduit and along the length of the wall for being directed to a conduit adapter and/or storage compartment of a mounting device.

In one embodiment, the engineered block 200 preferably includes a second channel 206 that extends from a rear face 208 of the block toward a front face 210 of the block 200. The second channel 206 is desirably adapted to receive conduit, which, in turn, is adapted to receive electrical wiring. The engineered block 200 also desirably includes the stepped cavity 212 formed in the top surface 202 that is adapted to receive a light fixture mounting device 120.

Figure 17:
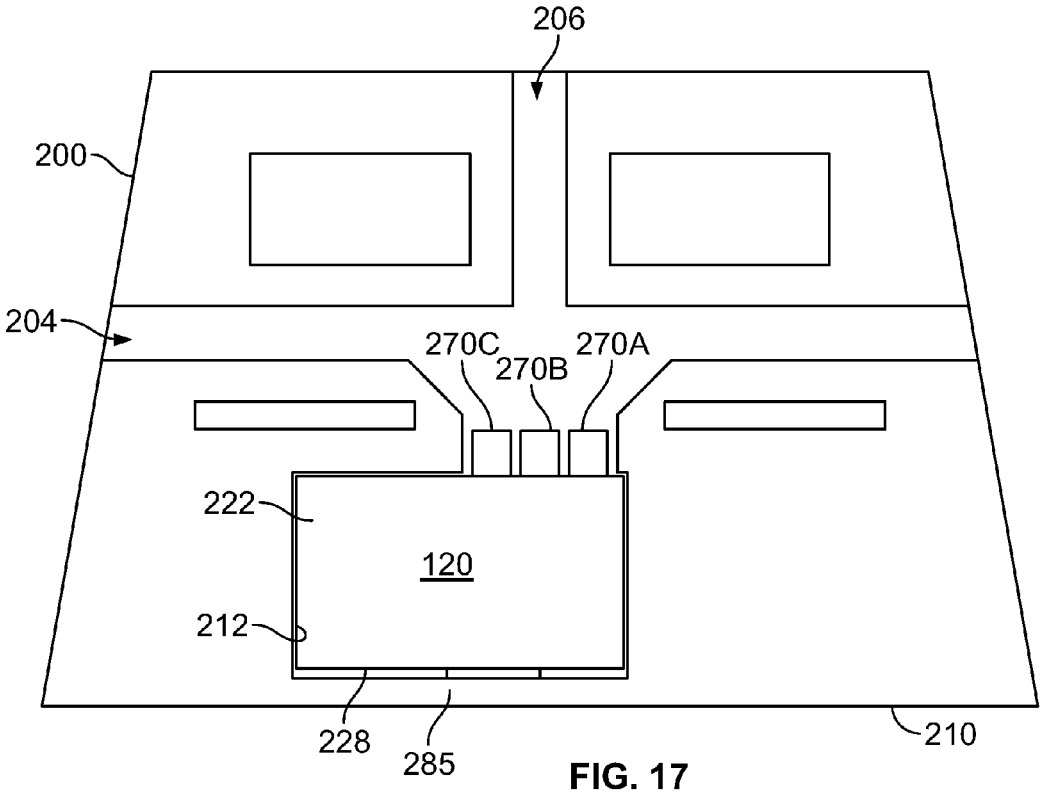
FIG. 17 shows a top plan view of the engineered block and mounting device shown in FIG. 16.

Referring to FIG. 17, in one embodiment, the mounting device 120 is preferably inserted into the stepped cavity 212 of the engineered block 200. The tubes 270A-270C of a conduit adapter 260 preferably extend into a conduit hub area defined by the intersection of the first channel 204 and the second channel 206. The flexible conduit (not shown) may pass through the first and second conduits 204, 206 and into the tubes 270A-270C of the conduit adapter for providing a path for electrical wiring to be advanced into the storage compartment of the mounting device 120. When it is desired to secure a light fixture to the mounting device 120, a front cover section 285 of the engineered block 200, that extends between the front face 210 of the block 200 and the stepped cavity 212, may be selectively removed for exposing the elongated slot formed in the flat plate and the front opening of the storage compartment (FIG. 3).

In one embodiment, the engineered block 200 is supplied from a block manufacturer with a recessed, stepped cavity formed in each block, whereby the stepped cavity is adapted to seat the mounting device 120. The stepped cavity 212 is preferably configured for securely holding the mounting device 120 within the cavity so that the leading edge 128 of the flat plate 122 of the device 120 is parallel with the front face 210 of the block 200. After an installer arranges the engineered blocks at a desired height and spacing, the installer may remove some of the front cover sections 285 on some of the blocks. The front cover sections 285 may be removed, such as by using a chisel, saw, or other tool of the trade, for exposing the mounting device and enabling the leading edge of the mounting device to be aligned with the front face 210 of the engineered block 200, which also defines the front face of the wall. In one embodiment, the mounting devices 120 may be secured within the stepped cavities of the engineered blocks using adhesive materials commonly used in the wall construction industry.

In one embodiment, a wall may be built using the engineered blocks shown and described above in FIGS. 16 and 17. Some of the engineered blocks may have the mounting devices pre-installed therein (e.g. at the factory). Thus, two types of engineered block may be provided for installers or masons—a first type of block having a mounting device and a second type of block having no mounting device. The wall may be built with the first type of block interspersed between the second type of block for spacing light fixtures along the length and/or height of the wall. In one embodiment, the front cover sections 285 of selected engineered blocks may be removed where it is desired to position landscape light fixtures.

In one embodiment, a contractor may break away the front cover section 285 of an engineered block 200 when it is desired to position a light fixture in the block. If a light fixture will not be secured to the engineered block, then the front cover section 285 will not be removed. In one embodiment, a block manufacturer preferably includes the front cover section 285 in each block that is manufactured and sold. When constructing a wall using the engineered blocks 200, an installer can modify any of the blocks by removing the front cover section 285, which enables the contractor to position a mounting device within the block for securing a light fixture to the block.

Figure 18A:
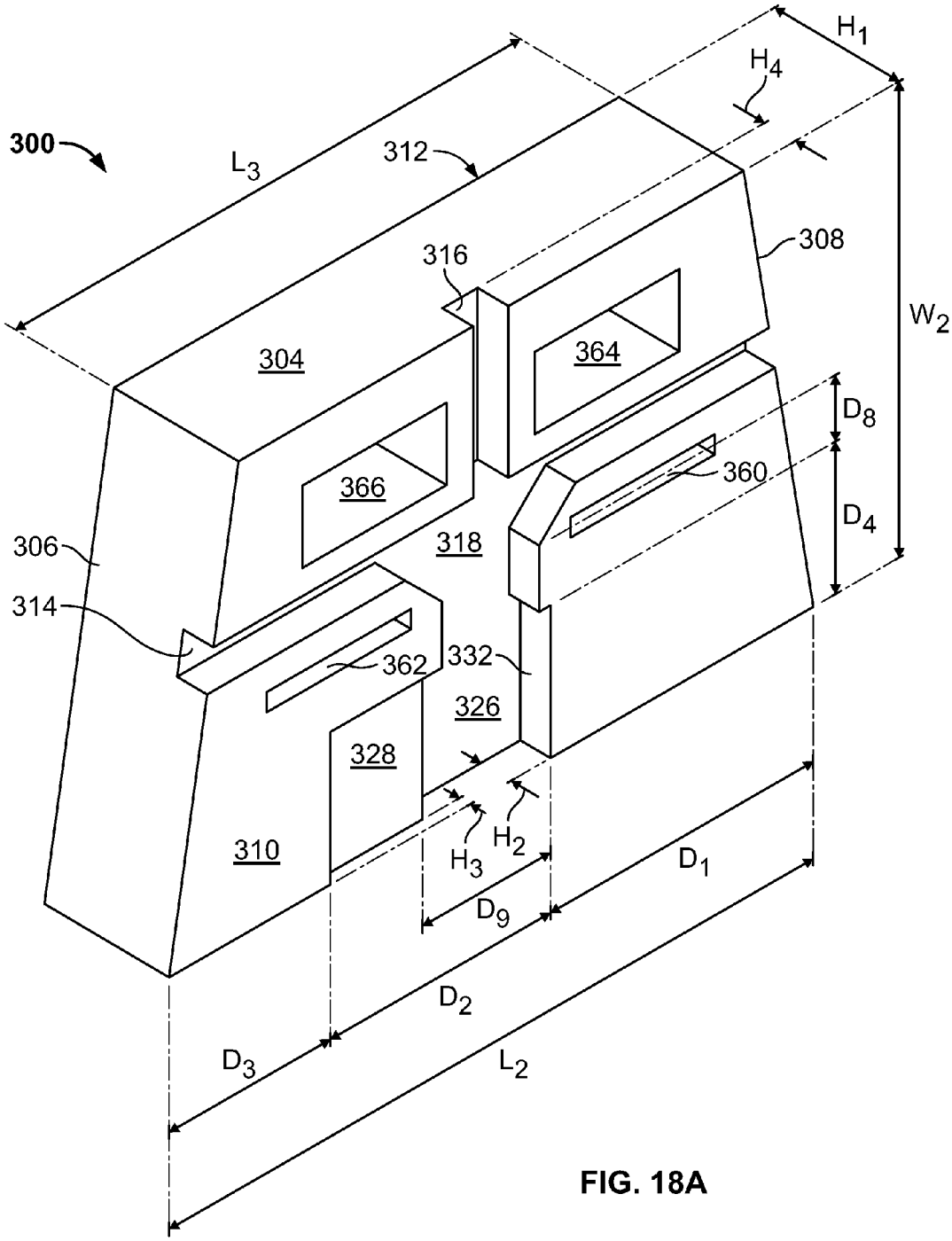
FIG. 18A shows a perspective view of an engineered block used for constructing a landscape wall, the engineered block having a mounting device cavity, in accordance with another embodiment of the present invention.
Figure 18B:
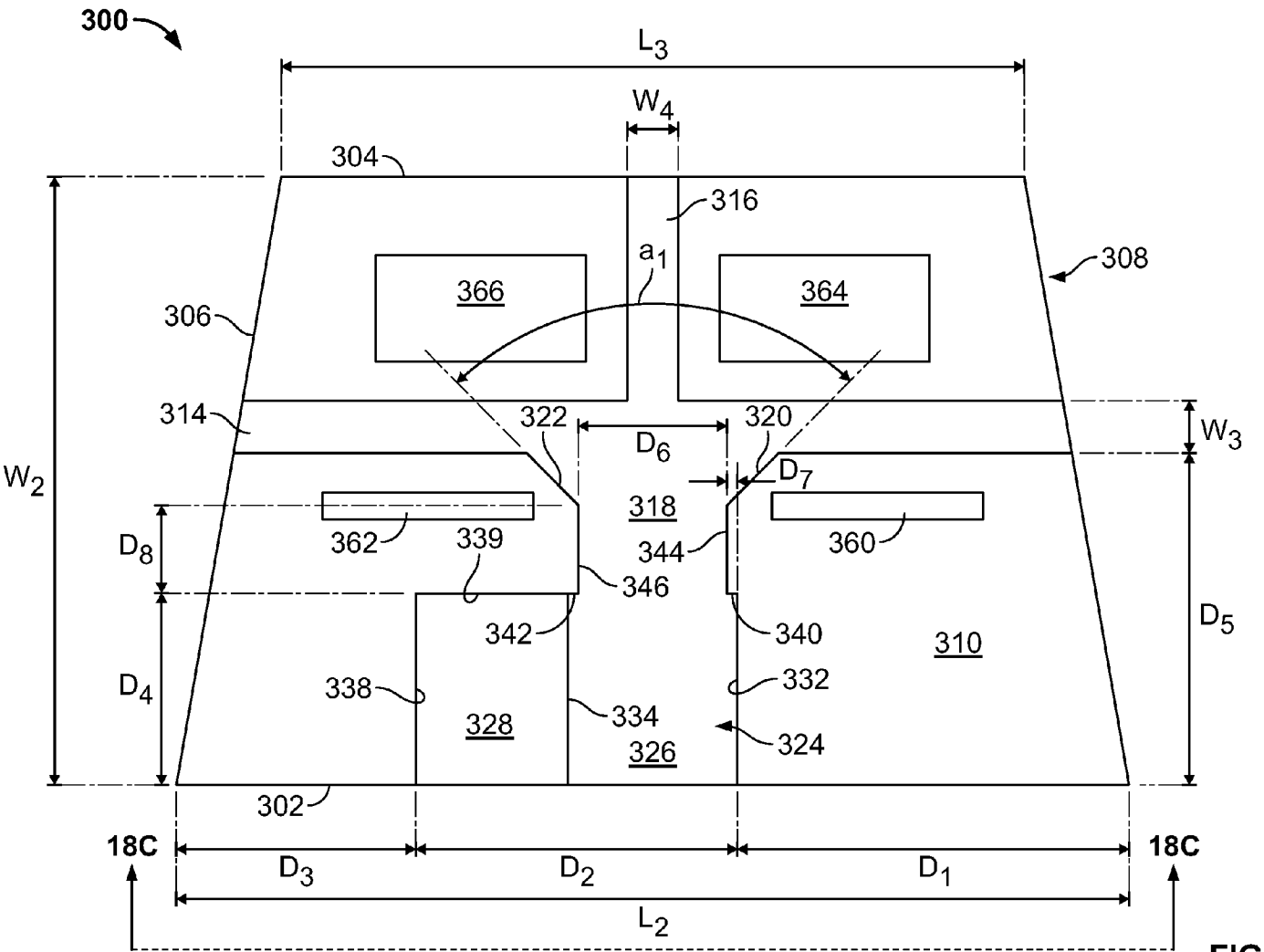
FIG. 18B shows a top plan of the engineered block shown in FIG. 18A.
Figure 18C:
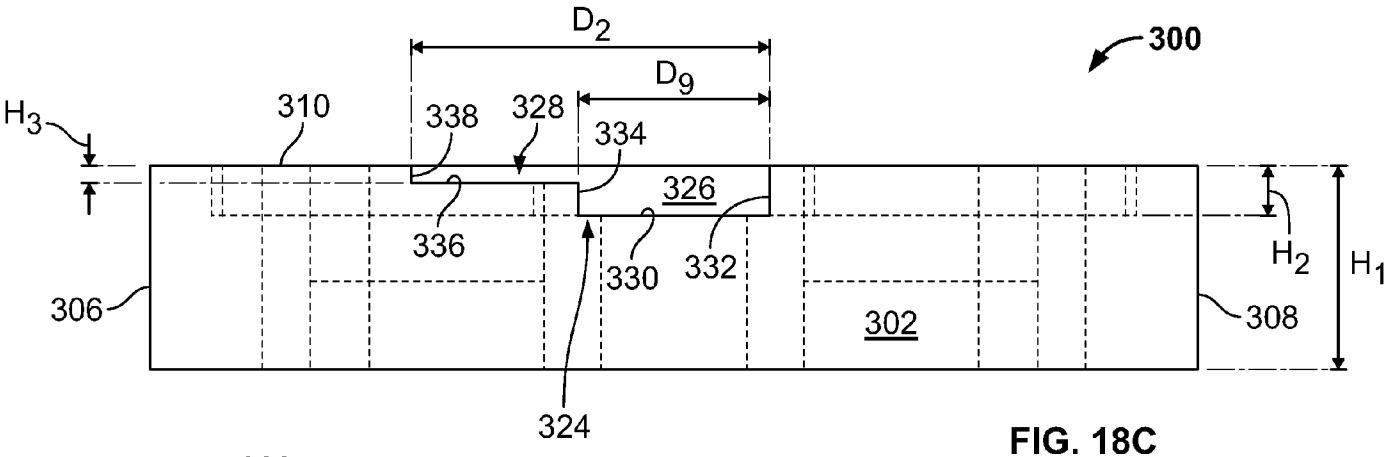
FIG. 18C shows a front elevation view of the engineered block shown in FIGS. 18A and 18B.

Referring to FIGS. 18A-18C, in one embodiment, an engineered block 300 preferably includes a front face 302, a rear face 304, and first and second sidewalls 306, 308 that extend between the front face 302 and the rear face 304. In one embodiment, the first and second sidewalls 306, 308 are preferably angled relative to one another and desirably taper inwardly between the front face 302 and the rear face 304 of the block. The engineered block 300 also desirably has a top surface 310 and a bottom surface 312. The top and bottom surfaces 310, 312 are preferably parallel with one another, and perpendicular with the front and rear faces 302, 304.

In one embodiment, the engineered block 300 desirably includes a first channel 314 that is formed in the top surface 310 and that extends along the length of the block between the first and second sidewalls 306, 308. In one embodiment, the first channel 314 desirably extends along an axis that is parallel with the front and rear faces 302, 304 of the block. The engineered block 300 also desirably includes a second channel 316 that extends from the rear face 304 toward the front face 302 of the block. The second channel preferably extends along an axis that is perpendicular to the front and rear faces 302, 304 of the block. The first and second channels 314, 316 are preferably elongated grooves formed and/or cut into the top surface 310 of the engineered block 300. In one embodiment, the first and second channels 314, 316 desirably have floors that lie below the top surface 310 of the engineered block. The first and second channels 314, 316 desirably intersect one another at a conduit hub 318 of the engineered block 300, which is preferably recessed relative to the top surface 310. The conduit hub 318 is bounded by angled walls 320, 322 that extend away from one another.

The engineered block 300 also preferably includes a stepped cavity 324 that is located between the conduit hub 318 and the front face 302 of the engineered block. The stepped cavity 324 is desirably recessed relative to the top surface 310 of the engineered block 300. In one embodiment, the stepped cavity 324 desirably includes a first step 326 and a second step 328 that is shallower than the first step 326. In one embodiment, the deeper first step 326 is adapted to seat the storage compartment 34 (FIGS. 1-3) of the mounting device and the shallower, second step 328 is adapted to seat the flat plate 22 (FIGS. 1-3) of the mounting device.

Referring to FIGS. 18B and 18C, in one embodiment, the deeper, first step 326 preferably includes a first horizontal surface 330 that is parallel with the top surface 310. The stepped cavity preferably has first and second interior sidewalls 332, 334 that are perpendicular to the first horizontal surface 330, and that extend away from the front face 302 and toward the conduit hub 318 of the engineered block 300. In one embodiment, the first interior sidewall 332 of the stepped cavity has a greater height than the opposing, second interior sidewall 334. The stepped cavity 324 also desirably includes the second step 328 that is shallower than the first step 326. The second step 328 preferably has a second horizontal surface 336 that is parallel with the top planar surface 310 of the engineered block 300. The stepped cavity preferably has a third interior sidewall 338 that extends between the second horizontal surface 336 and the top surface 310. The second step 328 is bounded by the second interior sidewall 334 and the third interior sidewall 338. The first and second interior sidewalls 332, 334 are desirably parallel with the third interior sidewall 338.

Referring to FIG. 18B, in one embodiment, the rear section of the first step 326 desirably includes a first corner wall section 340 and a second corner wall section 342. The opposing first and second corner wall sections 340, 342 are preferably adapted engage the rear edges of the storage compartment of the mounting device for securely seating the mounting device upon the first step. The first and second corner wall sections 340, 342 preferably have respective faces that extend parallel to the front face 302 of the engineered block 300. The first corner wall section 340 desirably extends between a first sidewall 344 of the conduit hub 318 and the first interior sidewall 332 of the stepped cavity, and the second corner wall section 342 desirably extends between a second sidewall 346 of the conduit hub 318 and the second interior sidewall 334 of the stepped cavity.

Referring to FIGS. 18A-18C, in one embodiment, the front face 302 of the engineered block 300 has a length $L_2$ of about 18 inches. The distance $D_1$ between first interior sidewall 332 of the stepped cavity 324 and the right front corner of the engineered block 300 is about 7.36 inches. The distance $D_2$ between the first interior sidewall 332 and the third interior sidewall 338 is about 6.13 inches, which is also the preferred length of the flat plate of the mounting device. The distance $D_3$ between the third interior sidewall 338 and the left front corner of the engineered block 300 is about 4.52 inches.

The width $W_2$ of the engineered block, measured between the front face 302 and the rear face 304 of the block 300, is about 11.50 inches. A rear interior wall 339 of the stepped cavity 324 is spaced a distance $D_4$ of about 3.63 inches from the front face 302 of the engineered block 300. The length $L_3$ of the rear face 304 of the engineered block is about 14.13 inches. The $W_3$ of the first channel 314 is about 1.00 inches, and the width $W_4$ of the second channel 316 is also about 1.00 inches. The distance $D_5$ between the front face 302 of the block 300 and the front side of the first channel 314 is about 6.25 inches. The opposing sidewalls 344, 346 of the conduit hub 318 are spaced apart a distance $D_6$ of about 2.75 inches. The length $D_7$ of the first corner wall section 340, which is defined as the distance between the interior sidewall 344 of the conduit hub 318 and the first interior sidewall 332 of the stepped cavity 324 is about 0.27 inches. The angled walls 320, 322 define an angle $\alpha_1$ of about 90°. The distance $D_8$ between the rear interior wall 339 of the stepped cavity 324 and the leading ends of the angled walls 320, 322 is about 1.63 inches.

Referring FIGS. 18A and 18C, in one embodiment, the distance $D_9$ between the opposing first and second interior sidewalls 332, 334 of the stepped cavity 324 is 3.29 inches. The first and second sidewalls 306, 308 of the engineered block 300 have a height $H_1$ of 3.50 inches. In one embodiment, the first interior sidewall 332 of the stepped cavity 324 desirably has a height $H_2$ of about 0.88 inches. The third interior sidewall 338 of the stepped cavity 324 desirably has a height $H_3$ of 0.25 inches. Referring to FIG. 18A, in one embodiment, the second channel 316 has a height $H_4$ of about 0.88 inches. The first channel 314 preferably has the same height $H_4$ as the second channel 316. Thus, the first horizontal surface 330 of the first step 326 and the floors of the respective first and second channels 314, 316 are desirably a distance of about 0.88 inches from the top surface 310 of the engineered block 300.

Referring to FIGS. 18A and 18B, in one embodiment, the engineered block 300 desirably includes a pair of elongated alignment slots 360, 362 that extend from the top surface 310 to the bottom surface of the engineered block. The elongated alignment slots 360, 362 are desirably utilized for aligning a stack of engineered blocks with one another. In some embodiments, a curable material such as cement may be poured into the elongated alignment slots 360, 362 for joining a vertical stack of engineered blocks together. Block vertical courses may also be secured using pins, plastic blocks, adhesive cement, and notches that nest one course to the next. The engineered block 300 may also desirably include a pair of rear alignment slots 364, 366 that extend from the top surface 310 to the bottom surface of the engineered block. The rear alignment slots 364, 366 are also desirably used for aligning a vertical stack of engineered blocks. Curable materials, such as cement, may be poured into the rear alignment slots 364, 366 for permanently joining together a plurality of engineered blocks stacked together in a vertical array.

Figure 19A:
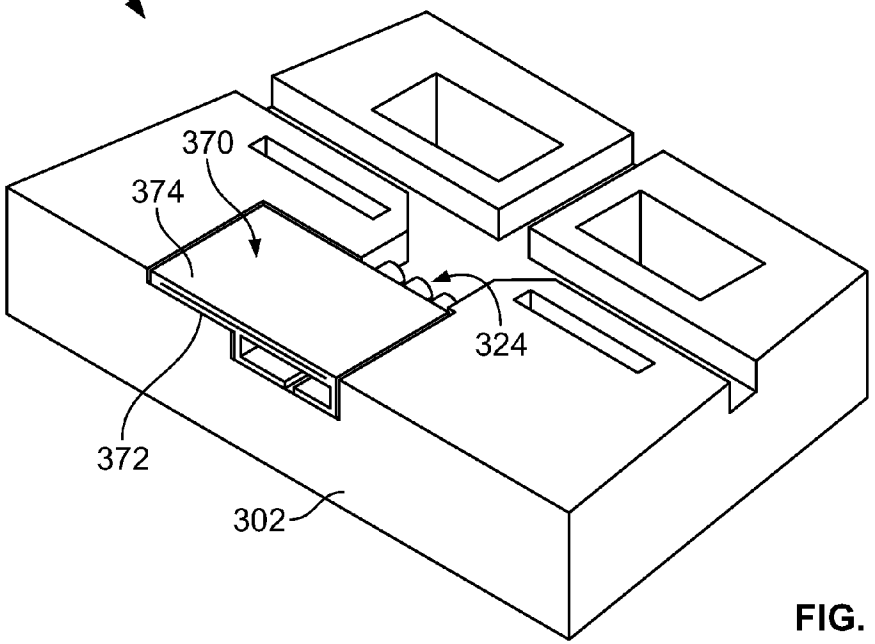
FIG. 19A shows a perspective view of the engineered block of FIG. 18A with a light fixture mounting device disposed within a mounting device cavity of the engineered block, in accordance with one embodiment of the present invention.
Figure 19B:
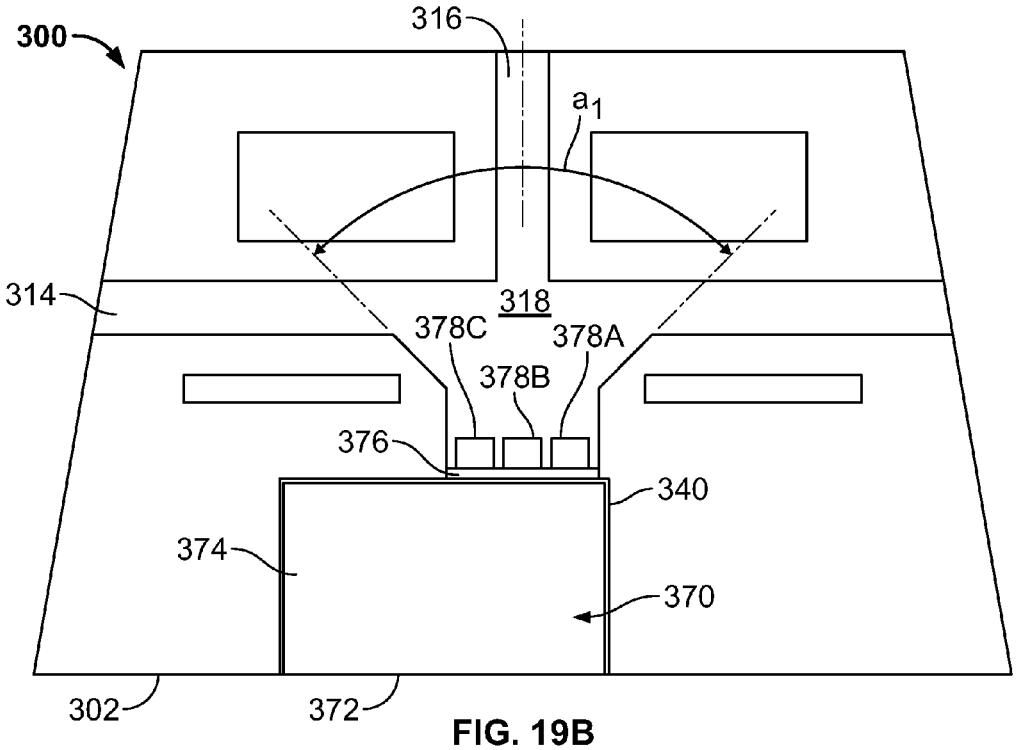
FIG. 19B shows a top plan view of the engineered block and the mounting device shown in FIG. 19A.

Referring to FIG. 19A, a landscape lighting mounting device 370 may be seated within the stepped cavity 324 of the engineered block 300. Referring to FIGS. 19A and 19B, the leading edge 372 of the flat plate 374 of the mounting device 370 preferably extends along the front face 302 of the engineered block 300. Referring to FIGS. 19A and 19B, a rear right corner of the flat plate 374 is desirably seated within the first corner wall section 340 of the stepped cavity for forming a secure fit between the mounting device 340 and the first and second steps of the stepped cavity. The mounting device 370 desirably includes the conduit adapter 376 including conduit tubes 378A, 378B, 378C that project into the conduit hub 318 of the block 300. Conduit may be seated within the first and second conduit channels 314, 316 for directing electrical wiring through the conduit tubes 378A, 378B, 378C and into the storage compartment of the mounting device. The conduit may be coupled with the conduit tubes 378A, 378C.

Figure 19C:
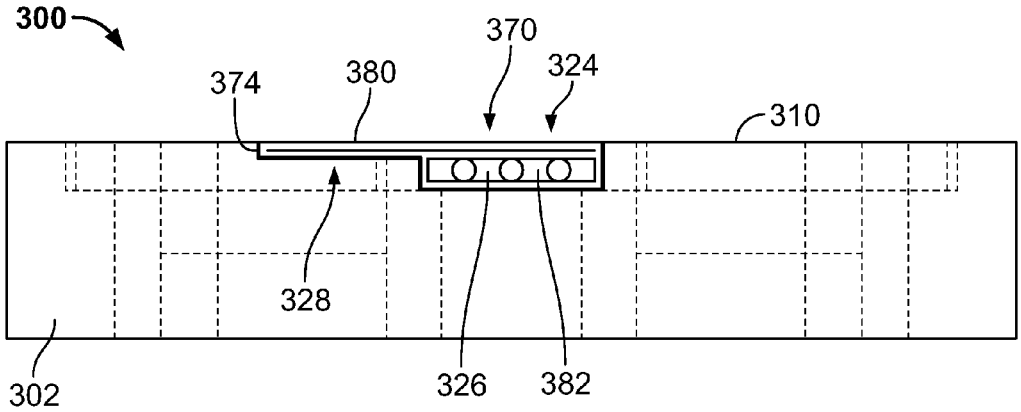
FIG. 19C shows a front elevation view of the engineered block and the mounting device shown in FIGS. 19A and 19B.

FIG. 19C shows the mounting device 370 seated within the stepped cavity 324 of the engineered block 300. When the mounting device 370 is seated within the stepped cavity 324, the top surface 380 of the flat plate 374 of the mounting device 370 is preferably parallel with the top surface 310 of the engineered block. The storage compartment 382 of the mounting device 370 is desirably seated atop the first step 326. The flat plate 374 of the mounting device 370 is preferably seated atop the shallower, second step 328 of the engineered block. The opening of the storage compartment 328 and the elongated slot accessible at the leading edge of the flat plate 374 are desirably accessible at the front face 302 of the engineered block 300.

Figure 20A:
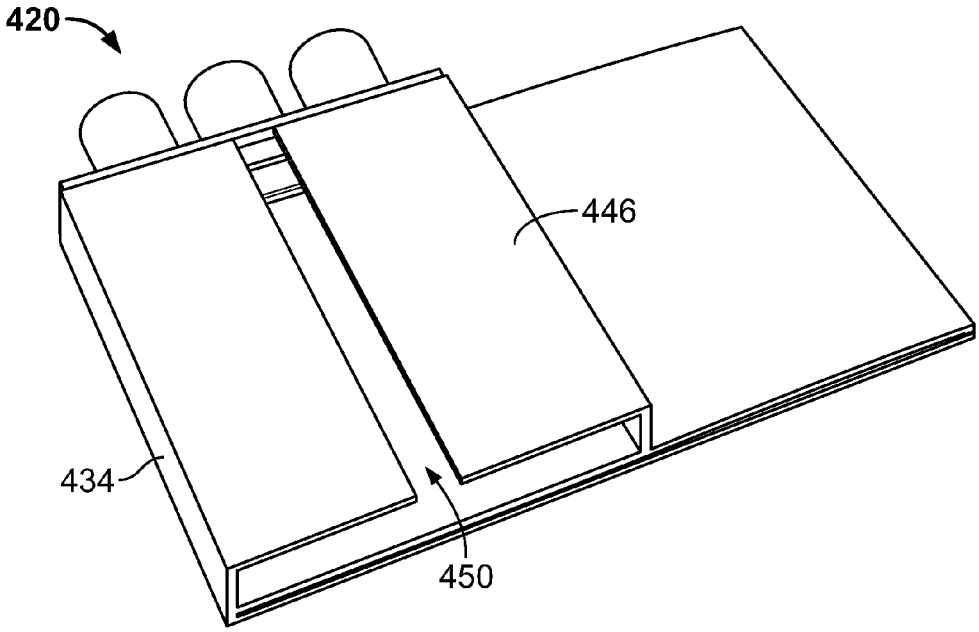
FIGS. 20A-20D show a method of using a mounting device for a light fixture, in accordance with one embodiment of the present invention.
Figure 20B:
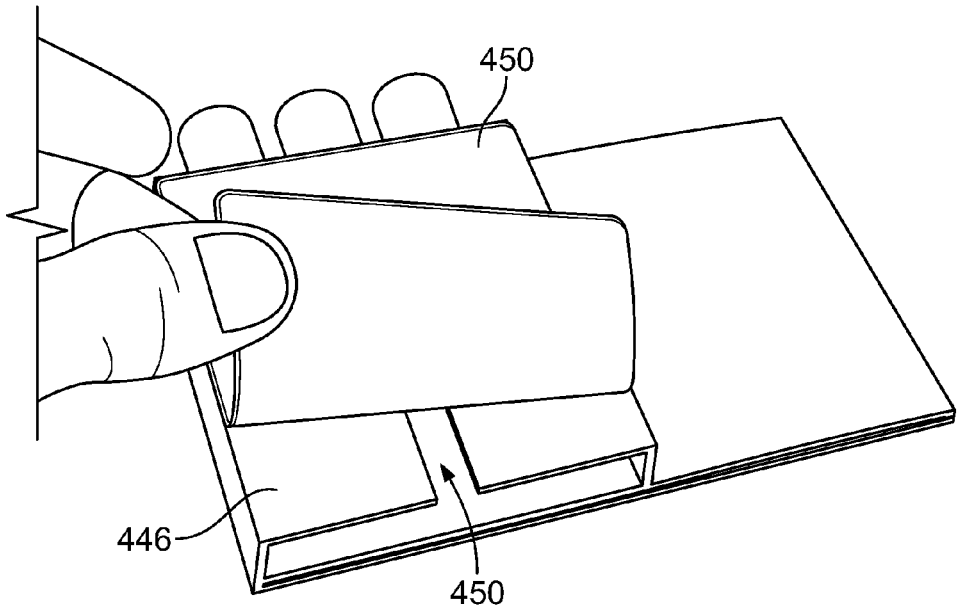
Figure 20C:
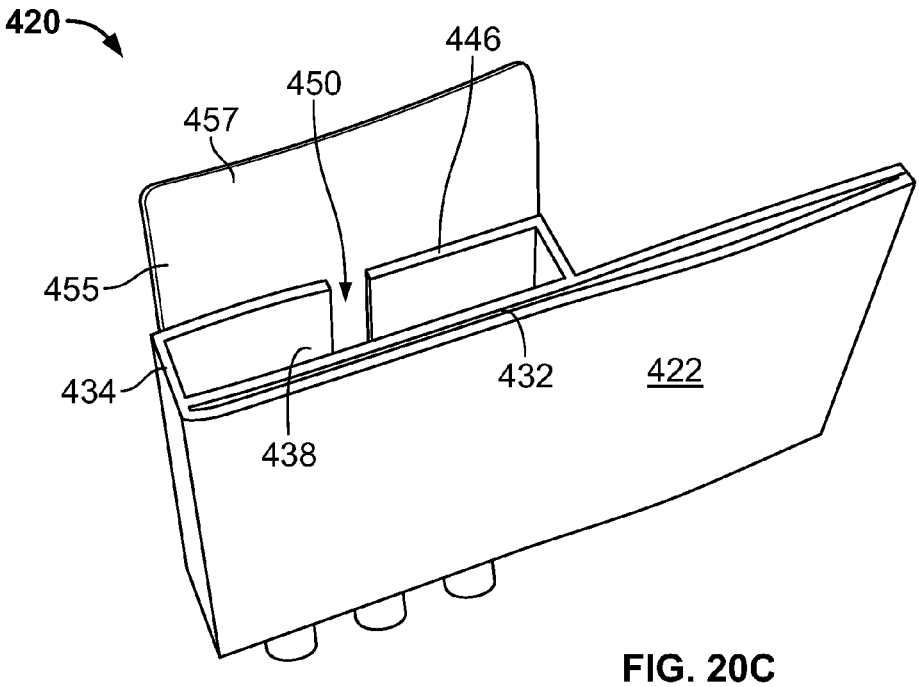
Figure 20D:
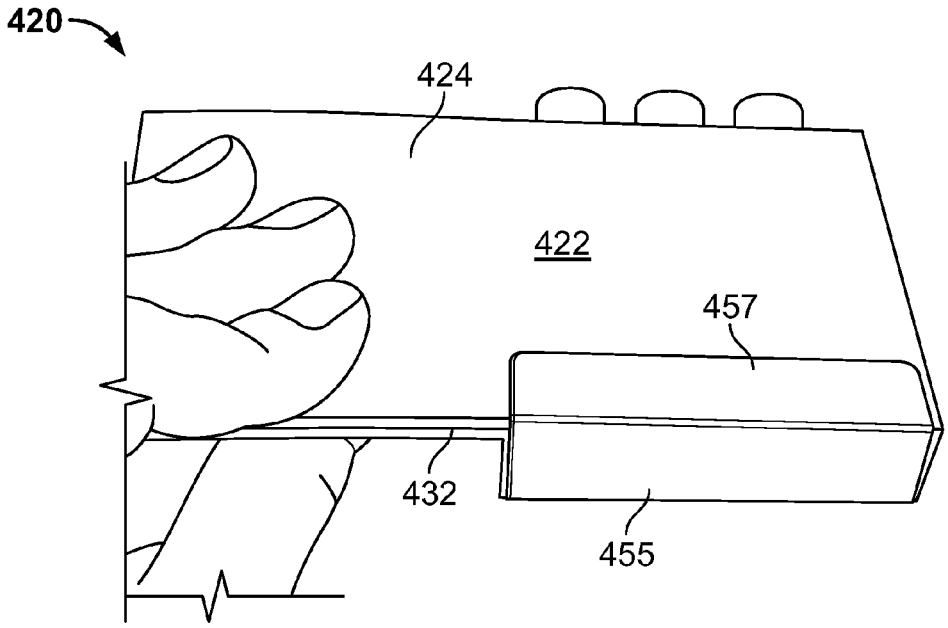

In one embodiment, a label may be used for sealing the storage compartment and the elongated slot in the flat plate from construction debris. The label may bear the manufacturer's name or logo, and/or instructions for utilizing the light fixture mounting system. Referring to FIG. 20A, in one embodiment, a mounting device 420 preferably includes a storage compartment 434 having a bottom wall 446 and an elongated gap 450 formed in the bottom wall 446. Referring to FIGS. 20B and 20C, an adhesive label 455 may be placed over the bottom wall 446 for sealing the elongated gap 450 so as to prevent concrete and other construction debris from entering the enclosed area 436 of the storage compartment 434. Referring to FIGS. 20C and 20D, the front flap 457 of the adhesive label 455 may be wrapped around the front of the mounting device 420 for covering the front opening 438 of the storage compartment 434. The free end of the front flap 457 may be adhered to the top planar surface 424 of the flat plate 422 for protecting the storage compartment and at least a portion of the elongated slot 432 formed in the flat plate 422. The front flap 457 of the adhesive label 455 may be opened and closed as necessary by peeling the front flap 457 away from the flat plate 422 and later re-adhering the front flap 457 of the adhesive label 455 to the top planar surface 424 of the flat plate 422.

Figure 20E:
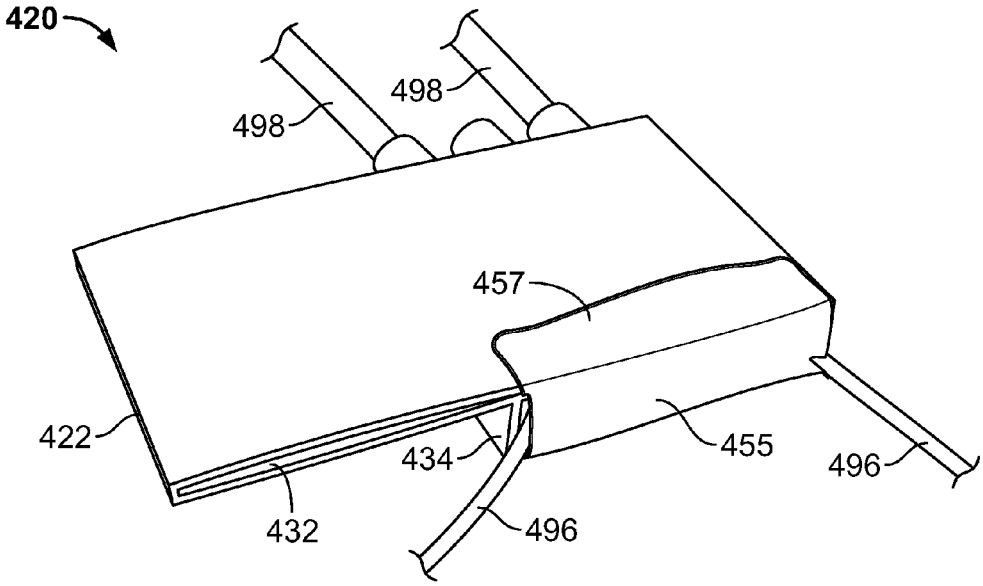
Figure 20F:
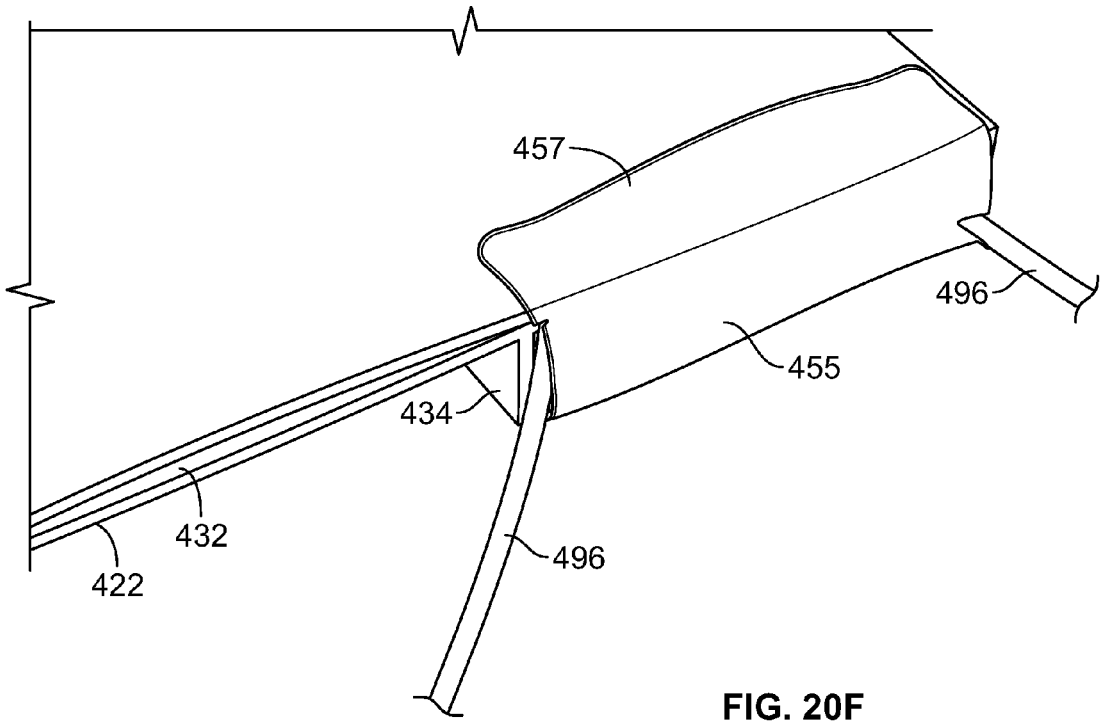

The adhesive label may be used for holding electrical wires in place prior to the wires being electrically interconnected with a light fixture. FIG. 20E shows an embodiment whereby electrical wires have been passed through flexible conduit 498 and the front opening of the storage compartment 434 for being pre-positioned to extend from the front of the mounting device 420. The adhesive label 455 preferably holds the electrical wires in place and seals the front of the storage compartment 434 to prevent construction debris from entering the storage compartment and at least a portion of the elongated slot 432 formed in the flat plate 422. Referring to FIG. 20F, when it is desired to secure a light fixture to the mounting device, the front flap 457 of the adhesive label 455 may be peeled away for exposing the front opening of the storage compartment 434 so that the electrical wires 496 may be electrically interconnected with a light fixture.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. An engineered block for a landscape wall comprising:

a front face;

a rear face;

first and second sidewalls extending between said front and rear faces;

a top surface extending between upper ends of said front and rear faces;

a bottom surface extending between lower ends of said front and rear faces;

a stepped cavity formed in said top surface of said engineered block, said stepped cavity being located adjacent said front face of said engineered block and including a first step having a first horizontal surface spaced a first distance from said top surface of said engineered block, and a second step, adjacent said first step, having a second horizontal surface spaced a second distance from said top surface of said engineered block that is less than the first distance: wherein said first and second horizontal surfaces of said first and second steps are parallel to said top surface of said engineered block; and wherein said stepped cavity further comprises a first interior sidewall that extends between said first horizontal surface and said top surface of said engineered block, and an opposing second interior sidewall that extends between said first horizontal surface and said second horizontal surface, and wherein said first and second interior sidewalls are parallel to one another and perpendicular to said top surface of said engineered block.

2. The engineered block as claimed in claim 1, wherein said first interior sidewall has a height that is greater than said second interior sidewall, and wherein said first and second interior sidewalls extend away from said front face of said engineered block.

3. The engineered block as claimed in claim 2, wherein said stepped cavity further comprises a third interior sidewall that extends between said second horizontal surface and said top surface of said engineered block, wherein said third interior sidewall is parallel to said second interior sidewall and perpendicular to said top surface of said engineered block, and wherein said third interior sidewall has a height that is less than the height of said second interior sidewall.

4. The engineered block as claimed in claim 1, further comprising:

a first conduit channel formed in said top surface of said engineered block and extending between said first and second sidewalls; and a second conduit channel formed in said top surface of said engineered block and extending from said rear face toward said front face of said engineered block, said first and second conduit channels intersecting one another at a conduit hub located adjacent said stepped cavity.

5. The engineered block as claimed in claim 4, wherein said conduit hub is located between said first step of said stepped cavity and said rear face of said engineered block.

6. The engineered block as claimed in claim 5, further comprising a light fixture mounting device seated in said stepped cavity of said engineered block, said light fixture mounting device including a flat plate having a top planar surface and a bottom planar surface, an elongated slot extending between said top and bottom planar surfaces and along a leading edge of said flat plate, and a storage compartment defining an enclosed area underlying said bottom planar surface of said flat plate, wherein said storage compartment is seated upon said first step of said stepped cavity and said flat plate is seated upon said second step of said stepped cavity with said top planar surface of said flat plate being coplanar with said top surface of said engineered block.

7. The engineered block as claimed in claim 6, wherein said storage compartment has a front opening that is located below said leading edge of said flat plate and a rear opening adjacent a trailing edge of said flat plate, and wherein said leading edge of said flat plate and said front opening of said storage compartment are adjacent said front face of said engineered block and said rear opening of said storage compartment is aligned with said conduit hub.

8. The engineered block as claimed in claim 7, wherein said leading edge of said flat plate and said front opening of said storage compartment extend along and are aligned with said front face of said engineered block.

9. The engineered block as claimed in claim 7, wherein said engineered block comprises a removable cover section covering a front end of said first and second steps, said leading edge of said flat plate, and said front opening of said storage compartment, and wherein said removable cover section is selectively removable for exposing said leading edge of said flat plate and said front opening of said storage compartment.

10. The engineered block as claimed in claim 6, further comprising:

a conduit adapter secured to said rear opening of said storage compartment; and conduit extending through at least one of said first and second conduit channels and being coupled with said conduit adapter.

11. The engineered block as claimed in claim 10, further comprising:

a light fixture having a securing flange projecting therefrom that is inserted into said elongated slot of said flat plate for securing said light fixture to said mounting device; and electrical wiring extending through said conduit and said conduit adapter for being electrically coupled with said light fixture.

12. An engineered block for a landscape wall comprising:

said engineered block having a front face, a rear face, first and second sidewalls, a top surface, and a bottom surface;

a stepped cavity formed in said top surface of said engineered block, said stepped cavity being located adjacent said front face of said engineered block and including a first step having a first horizontal surface, and a second step, adjacent said first step, having a second horizontal surface that is shallower than said first step;

a light fixture mounting device seated in said stepped cavity, said light fixture mounting device including a flat plate having a top planar surface and a bottom planar surface, an elongated slot extending along a leading edge of said flat plate, and a storage compartment defining an enclosed area underlying said bottom planar surface of said flat plate, wherein said storage compartment is seated upon said first step, said flat plate is seated upon said second step, and said top planar surface of said flat plate is coplanar with said top surface of said engineered block.

13. The engineered block as claimed in claim 12, wherein said stepped cavity comprises a first interior sidewall that extends between said first horizontal surface and said top surface of said engineered block, and an opposing second interior sidewall that extends between said first horizontal surface and said second horizontal surface of said second step, wherein said first and second interior sidewalls are parallel to one another and perpendicular to said top surface of said engineered block, and wherein said first interior sidewall has a height that is greater than said second interior sidewall.

14. The engineered block as claimed in claim 13, wherein said stepped cavity comprises a third interior sidewall that extends between said second horizontal surface of said second step and said top surface of said engineered block, wherein said third interior sidewall is parallel to said second interior sidewall, and wherein said third interior sidewall has a height that is less than the height of said second interior sidewall.

15. The engineered block as claimed in claim 14, wherein said stepped cavity further comprises a rear interior wall that extends vertically between a rear end of said second horizontal surface and said top surface of said engineered block, wherein said rear wall is parallel to said front face of said engineered block and perpendicular to said top surface of said engineered block.

16. The engineered block as claimed in claim 12, further comprising a light fixture mounting device seated in said stepped cavity of said engineered block, said light fixture mounting device including a flat plate having a top planar surface and a bottom planar surface, an elongated slot extending between said top and bottom planar surfaces and along a leading edge of said flat plate, and a storage compartment defining an enclosed area underlying said bottom planar surface of said flat plate, wherein said storage compartment is seated upon said first step of said stepped cavity, said flat plate is seated upon said second step of said stepped cavity, and said top planar surface of said flat plate is coplanar with said top surface of said engineered block.

17. The engineered block as claimed in claim 16, wherein said flat plate has a length that is equal to the distance between said first interior wall and said third interior wall, and wherein said flat plate has a width that is equal to the distance between said rear interior wall and said front face of said engineered block.

18. An engineered block for a landscape wall comprising:

said engineered block having a front face, a rear face, and a top surface extending between said front and rear faces;

a stepped cavity formed in said top surface of said engineered block, said stepped cavity being located adjacent said front face of said engineered block and having a first step with a first horizontal surface that is parallel to said top surface of said engineered block, and a second step with a second horizontal surface that is parallel to said top surface of said engineered block, wherein said second horizontal surface is closer to said top surface of said engineered block than said first horizontal surface; and a light fixture mounting device having a flat plate with a top planar surface and a bottom planar surface, an elongated slot extending between said top and bottom planar surfaces and along a leading edge of said flat plate, and a storage compartment defining an enclosed area underlying said bottom planar surface of said flat plate, wherein said mounting device is disposed within said stepped cavity with said storage compartment seated upon said first step, said flat plate seated upon said second step, and said top planar surface of said flat plate being coplanar with said top surface of said engineered block.

* * * * *